US005266058A

United States Patent [19]

Sako et al.

[11] Patent Number: 5,266,058

[45] Date of Patent: Nov. 30, 1993

[54] TERMINAL CONNECTING DEVICE

[75] Inventors: Yuji Sako; Shigeharu Ohtsuka; Hiroyuki Okado; Naoki Itoh, all of Aichi, Japan

[73] Assignee: Mitsubishi Denki K.K., Tokyo, Japan

[21] Appl. No.: 954,145

[22] Filed: Sep. 30, 1992

[30] Foreign Application Priority Data

Oct. 1, 1991 [JP] Japan ..... 3-253715
Mar. 27, 1992 [JP] Japan ..... 4-071243

[51] Int. Cl.[5] ..... H01R 9/24
[52] U.S. Cl. ..... 439/813; 439/709
[58] Field of Search ..... 439/801, 813, 709

[56] References Cited

U.S. PATENT DOCUMENTS 4,531,797 7/1985 Jullien et al. ..... 439/813

FOREIGN PATENT DOCUMENTS 144990 11/1980 German Democratic Rep. ..... 439/801
60-130068 7/1985 Japan .
60-124868 8/1985 Japan .
62-222582 9/1987 Japan .
63-43807 11/1988 Japan .
1-12754 4/1989 Japan .

*Primary Examiner*—Gary F. Paumen
*Attorney, Agent, or Firm*—Sughrue, Mion, Zinn, Macpeak & Seas

[57] ABSTRACT

The present invention relates to a terminal connecting device which simplifies and facilitates achieving the proper alignment between a male-threaded portion of a terminal screw and a female-threaded hole of a stationary terminal, and moreover, which assures that a fastening operation is easily performed. The terminal connecting device includes a terminal screw guiding member adapted to be displaced along a side wall, the terminal screw being engaged with the terminal screw guiding member. The terminal screw or the terminal screw guiding member may also be supported by the resilient action of an elastic member of which one end is supported by the side wall. Alternatively, the terminal screws may be housed in a housing which is slidably attached to the side wall and which may be locked in place with the aid of a resilient member and latching apparatus.

28 Claims, 22 Drawing Sheets

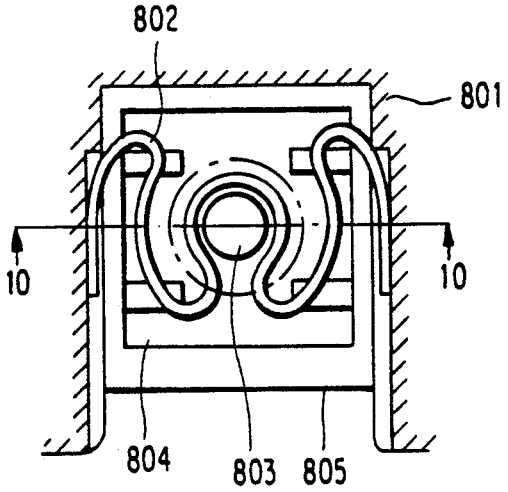
FIG. 9
PRIOR ART
FIG. 10
PRIOR ART
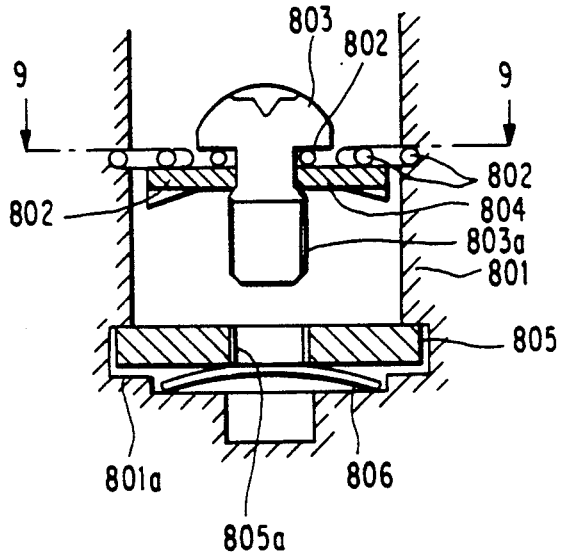
FIG. 11
PRIOR ART
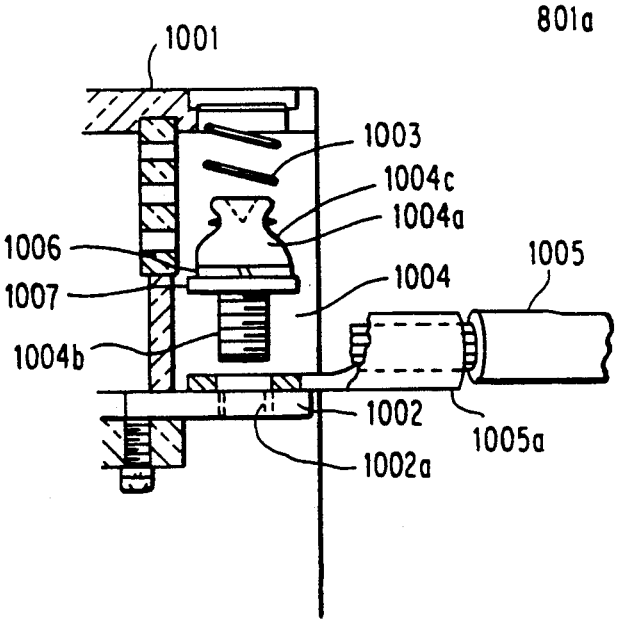

TERMINAL CONNECTING DEVICE

BACKGROUND OF THE INVENTION

1. Field of the Invention

The present invention relates to a terminal connecting device which ensures ease and efficiency in performing electrical or other connection operations.

2. Description of the Background Art

To facilitate understanding of the present invention, conventional type terminal connectors will be described below with reference to FIGS. 9–11.

FIG. 9 is a sectional plan view of a part of a conventional terminal connector disclosed in Japanese Unexamined Utility Model Publication No. 50-5160. FIG. 10 is a sectional front view of a part of the terminal connector shown in FIG. 9.

It should be noted that FIG. 9 is a sectional view of the terminal connector taken along line 9—9 in FIG. 10, and FIG. 10 is a sectional view of the terminal connector taken along line 10—10 in FIG. 9.

In FIGS. 9 and 10, reference numeral 801 designates a case for an apparatus on which the terminal connector is mounted while reference numeral 802 designates a meandering or snake-like spring of which opposite ends are supported by the case 801. Reference numeral 803 designates a terminal screw which is supported by the spring 802 at a central part thereof so as to be displaceable in the vertical direction as shown in FIG. 10. It should be noted that the terminal screw 803 is illustrated as divided, at an intermediate position, between a head portion and a male-threaded portion 803*a*. Reference numeral 804 designates a wire retainer for holding the object to be connected, reference numeral 805 designates a stationary terminal having a female-threaded hold 805*a* formed thereon, and reference numeral 806 designates a leaf spring which is received in an annular groove 801*a* for urging the stationary terminal 805 vertically upward.

A process for fastening and connecting a round type crimp terminal to the conventional terminal connector, as shown in FIGS. 9 and 10, is described hereinafter.

First, to ensure that the terminal screw 803 is inserted through a hole of the round type crimp terminal, the terminal screw 803 is loosened so that it is disengaged from the stationary terminal 805.

With the terminal screw 803 in a disengaged state, a gap is created between the male-threaded portion 803*a* and the stationary terminal 805, the gap being wider than at least one plate thickness of the stationary terminal 805.

Next, the round type crimp terminal is inserted into the terminal connector such that a hole of the round type crimp terminal is aligned with and located at a position between the male-threaded portion 803*a* of the terminal screw 803 and the female-threaded hole 805*a* of the stationary terminal 805.

Subsequently, when the terminal screw 803 is rotationally displaced vertically downward with the aid of a thread tightening tool (e.g., a screwdriver) so that it is threadably engaged with the female-threaded hold 805*a* of the stationary terminal 805, the round type crimp terminal is immovably fastened and connected to the stationary terminal 805.

FIG. 11 is a sectional front view of a part of another conventional terminal connector as disclosed in Japanese Unexamined Utility Model Publication No. 59-177176.

In FIG. 11, reference numeral 1001 designates a case for an apparatus on which the terminal connector is mounted, reference numeral 1002 designates a stationary terminal which is fixedly secured to the case 1001, reference numeral 1003 designates a coil spring, of which the upper end is held on the case 1001 and the lower end is suspended toward a female-threaded hold 1002*a* of the stationary terminal 1002, and reference numeral 1004 designates a terminal screw.

It should be noted that the terminal screw 1004 includes a spring washer 1006 and a washer 1007 each being undetachably interposed between a head portion 1004*a* and a male-threaded portion 1004*b*.

The lower end of the coil spring 1003 is fitted over an annular recess 1004*c* formed concentrically about the head portion 1004*a* of the terminal screw 1004 such that the male-threaded portion 1004*b* of the terminal screw 1004 is suspended toward the female-threaded hole 1002*a* of the stationary terminal 1002.

A process for connecting a round type crimp terminal to the conventional terminal connector, as shown in FIG. 11, is described hereinafter.

As shown in FIG. 11, when the terminal screw 1004 is disengaged from the stationary terminal 1002, the male-threaded portion 1004*b* of the terminal screw 1004 is suspended in spaced relationship relative to the stationary terminal 1002 by a distance greater than at least one plate thickness of the round type crimp terminal.

Next, the round type crimp terminal is inserted into the region located between the male-threaded portion 1004*b* of the terminal screw 1004 and the stationary terminal 1002 such that a hole of the round type crimp terminal positionally coincides with the female-threaded hole 1002*a* of the stationary terminal 1002.

As the terminal screw 1004 is displaced downwardly against the contracting force of the coil spring 1003, to be threadably fitted into the female-threaded hole 1002*a* of the stationary terminal 1002, the round type crimp terminal is fastened and connected to the stationary terminal 1002.

Where an open end type crimp terminal is to be fastened and connected to the conventional terminal connector, as shown in FIGS. 9 and 10, the terminal screw 803 is only slightly threaded into the female-threaded hold 805*a* of the stationary terminal 805, the open end type crimp terminal is inserted in the hollow space between the wire retainer 804 and the stationary terminal 805, and the terminal screw 803 is then displaced further in the downward direction so that it is secured to the stationary terminal 805.

Where one end of a cable, e.g., a naked wire, is to be connected, the terminal screw 803 is slightly threaded into the female-threaded hole 805*a* of the stationary terminal 805 in the same manner as described above. Then, while the foregoing threadably engaged state is maintained, the naked wire is inserted into the hollow space between the wire retainer 804 and the stationary terminal 805, and the terminal screw 803 is then displaced further in the downward direction until the naked wire is immovably secured to the stationary terminal 805.

When an open end type crimp terminal or a naked wire is to be immovably fastened and connected to the conventional terminal connector, as shown in FIG. 11, it can be fastened and connected in the same manner as described above with respect to the conventional terminal connector shown in FIGS. 9 and 10.

With the conventional terminal connector, as shown in FIGS. 9 and 10, the male-threaded portion 803a of the terminal screw 803 is typically difficult to position so as to coincide with the female-threaded hole 805a of the stationary terminal 805 as the terminal screw 803 and spring 802 are displaced downwardly toward the female-threaded hole 805a of the stationary terminal 805. In such a case, the terminal screw 803 must be displaced, by hand, in the horizontal (left or right) direction until the male-threaded part 803a of the terminal screw 803 positionally coincides with the female-threaded hole 805a of the stationary terminal 805. Thus, with the conventional apparatus, it is extremely difficult to achieve the proper alignment for fastening.

Furthermore, the conventional terminal connector, as shown in FIG. 11, suffers from the same problems as noted above with respect to the conventional terminal connector shown in FIGS. 9 and 10.

SUMMARY OF THE INVENTION

The present invention has been made in consideration of the aforementioned problems, and its objective resides in providing a terminal connecting device in which a male-threaded portion of the terminal screw is easily positioned to coincide with the female-threaded hole of a stationary terminal, and moreover, which assures that a fastening operation is simply and efficiently performed.

In first through ninth embodiments of the present invention, a terminal connector is provided having a stationary terminal with a female-threaded hole formed thereon, a supporting member including a stationary portion and a side wall, the stationary portion serving to immovably hold the stationary terminal, a terminal screw including a male-threaded portion adapted to be threadably engaged with the female-threaded hole of the stationary terminal, a terminal screw guiding member for guiding displacement of the terminal screw while the terminal screw guiding member is engaged with the terminal screw, the position of the terminal screw guiding member being determined such that the male-threaded portion of the terminal screw positionally coincides with the female-threaded hole of the stationary terminal, and at least one elastic member of which one end is supported by the side wall and the other end is fixedly secured to or engaged with the terminal screw or the terminal screw guiding member, the elastic member serving to hold the terminal screw and the terminal thread guiding member so as to form a gap or a hollow space between the male-threaded portion of the terminal-screw and the female-threaded hole of the stationary terminal.

Preferably, the elastic member and terminal screw guiding member are integrally formed.

The side wall is preferably provided with an engaging portion and the terminal screw guiding member is preferably provided with an engaged portion so that the terminal screw is held against the resilient force of the elastic member at the position where the male-threaded portion of the terminal screw abuts or is in close proximity with the female-threaded hole of the stationary terminal.

When the engagement portion on the side wall is brought into engagement with the engaged portion of the terminal screw guiding member, the terminal screw is held against the resilient force of the elastic member such that the male-threaded portion of the terminal screw comes in contact with the female-threaded hole of the stationary terminal or the former is located in close proximity to the latter. When the terminal connecting device is released from the foregoing engaged state, a gap or a hollow space is formed between the male-threaded portion of the terminal screw and the female-threaded hole of the stationary terminal.

In tenth through twenty-first embodiments of the present invention, the terminal connecting device (e.g., for use with a magnetic contactor) includes at least one holder for retaining the terminal screws in proper alignment with the female threaded terminal, the holder being displaceable in the same two positions as described above or, alternatively, in a third, different position. In these embodiments, the elastic member described above is entirely unnecessary as the holder is in sliding/frictional engagement with the body of the terminal connecting device and includes at least one resilient member preferably including a latch mechanism for securing the holder in either of the two positions described above. Finally, the holder may be employed with a series of terminal screws or, alternatively, with each individual terminal screw.

BRIEF DESCRIPTION OF THE DRAWINGS

FIG. 9 is a fragmentary, sectional, plan view of a conventional terminal connector as seen from above.

FIG. 10 is a fragmentary, sectional, front view of the same conventional terminal connector shown in FIG. 9.

FIG. 11 is a fragmentary, sectional, front view of a second, conventional terminal connector.

DETAILED DESCRIPTION OF THE INVENTION

The present invention will be described in detail hereinafter with reference to the accompanying drawings which illustrate preferred embodiments of the present invention.

Figure 1:
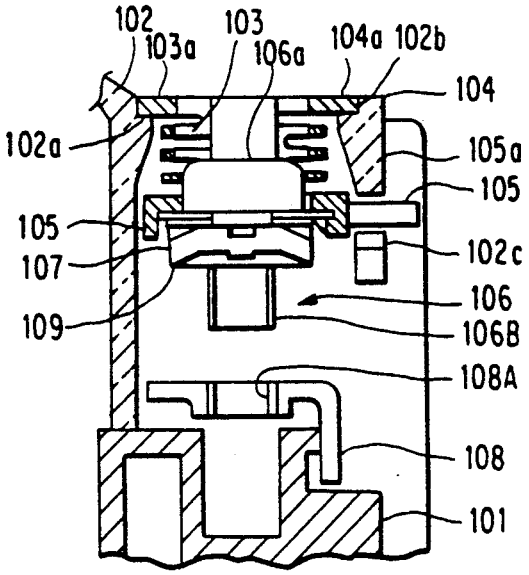
FIG. 1 is a fragmentary, sectional, front view of a terminal connecting device in accordance with a first embodiment of the present invention.

FIG. 1 is a fragmentary sectional front view of a terminal connecting device in accordance with a first embodiment of the present invention.

Figure 2:
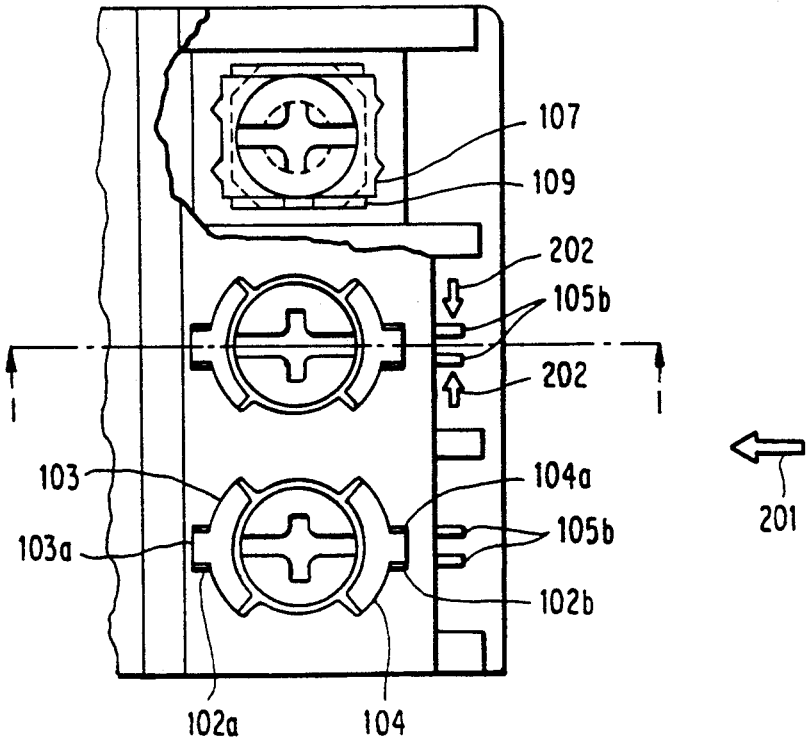
FIG. 2 is a fragmentary, sectional, plan view of the terminal connecting device in FIG. 1 as seen from above.
Figure 3:
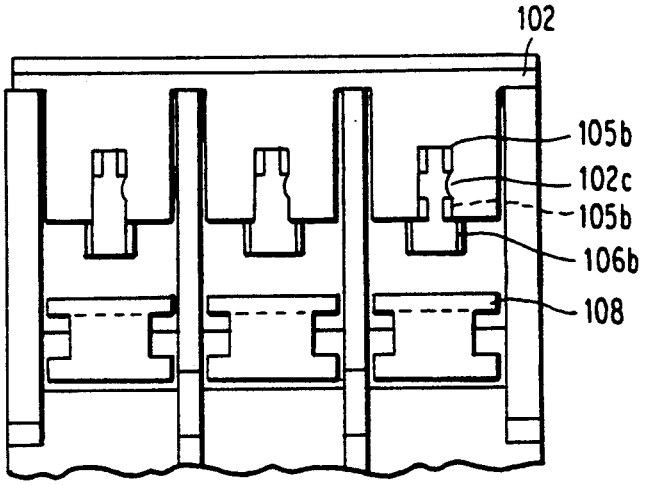
FIG. 3 is a fragmentary, sectional, side view of the terminal connecting device in FIG. 1 as seen from one side.

FIG. 2 is a plan view of the terminal connecting device in FIG. 1, as seen from above. FIG. 3 is a side view of the same. It should be noted that FIG. 3 is the side view of the terminal connecting device as seen in the direction designated by arrow 201 in FIG. 2.

In FIGS. 1-3, reference numeral 101 designates a case on which the terminal connecting device is mounted, and reference numeral 102 designates a side wall supported on the case 101 to serve as, e.g., a cover.

Reference numeral 103 designates a zigzag shaped spring. An upper support portion 103*a* of the spring 103 is fitted into a recess 102*a* of the cover 102. A supporting section is constructed for the terminal connecting device by two components, i.e., the case 101 and the cover 102.

Reference numeral 104 designates another zigzag shaped spring opposing the spring 103. An upper supporting portion 104*a* of the spring 104 is fitted into a recess 102*b* of the cover 102 for supporting the spring 104.

It should be noted that both springs 103 and 104 are preferably formed of an elastic member which expands in the vertical or insertion/removal direction of the terminal screw.

As shown in FIG. 2, each of the springs 103 and 104 exhibits an arc-shaped contour as seen from above, and both springs 103 and 104 are arranged such that their arched inside surfaces are opposite one another. It should be noted that the elastic section includes both springs 103 and 104.

Reference numeral 105 designates a terminal screw guiding member which is supported by the lower end of the spring 103 and the lower end of the spring 104.

Reference numeral 106 designates a terminal screw. The terminal screw 106 includes a head portion 106*a*, a male-threaded portion 106*b* and a washer 107 undetachably interposed between the two. In addition, a cable presser or wire retainer 109 is threadably fitted onto the male-threaded portion 106*b*.

The terminal screw 106 is immovably secured to the terminal screw guiding member 105 by fitting the outer peripheral part of the washer 107 into an annular groove 105*a* of the terminal screw guiding member 105. As is apparent from FIG. 1, the washer 107 is fitted into the annular groove 105*a* from below.

It should be noted that FIG. 2 is a plan view of the terminal connecting device and, for purposes of clarity, does not completely show the terminal screw guiding member 105 or a part of the cover 102 for one of three terminal screws 106.

Reference numeral 108 designates a stationary terminal which is supported on the case 101. The stationary terminal 108 is formed with a female-threaded hole 108*a* to which the terminal screw 106 is to be threadably engaged.

While the terminal screw 106 is disengaged from the female-threaded hole 108*a*, there exists a gap of predetermined width between the male-threaded portion 106 of the terminal screw 106 and the female-threaded hole 108*a* of the stationary terminal 108.

As the terminal screw 106 is displaced downwardly against the resilient force derived from both the springs 103 and 104, as seen in FIG. 1, the male-threaded portion 106*b* of the terminal screw 106 abuts or slightly engages the female-threaded hole 108*a* in the stationary terminal 108. Thus, the male-threaded portion 106*b* of the terminal screw 106 can be threadably engaged with the female-threaded hole 108*a* of the stationary terminal 108.

It should be noted that the downward displacement of the terminal screw guiding member 105 is properly guided by a terminal screw holder guide 99 formed in the side wall or cover 102 such that lowermost end of the male-threaded portion 106 of the terminal screw 106 positionally coincides with the uppermost end of the female-threaded hole 108*a* of the stationary terminal 108.

Reference numeral 102*c* designates an engaging portion which is disposed on the cover 102 in the form of, e.g., an engaging projection. In addition, reference numeral 105*b* designates an elastic engaged portion which is disposed on the terminal screw guiding member 105 in the form of, e.g., an elastic forked rod.

When the engaging projection 102*c* is brought in engagement with the forked rod 105*b*, the lowermost end of the male-threaded portion 106*b* of the terminal screw 106 abuts or is in close proximity to the uppermost end of the female-threaded hole 108*a* of the stationary terminal 108.

On the contrary, when the forked rod 105*b* is squeezed in the direction designated by the arrows 202 in FIG. 2, to thereby induce elastic deformation of the forked rod 105*b*, the rod is disengaged from the projection 102*c* such that the terminal screw 106 is displaced to the first position in which a gap of predetermined width is formed between the lowermost end of the male-threaded portion 106*b* of the terminal screw 106 and the uppermost end of the female-threaded hole 108*a* of the stationary terminal 108. In FIG. 3, the forked rod 105*b*, represented by solid lines in FIG. 3, is shown in a disengaged position. The dotted lines in FIG. 3 represent an engaged position of the forked rod 105*b*.

Figure 4:
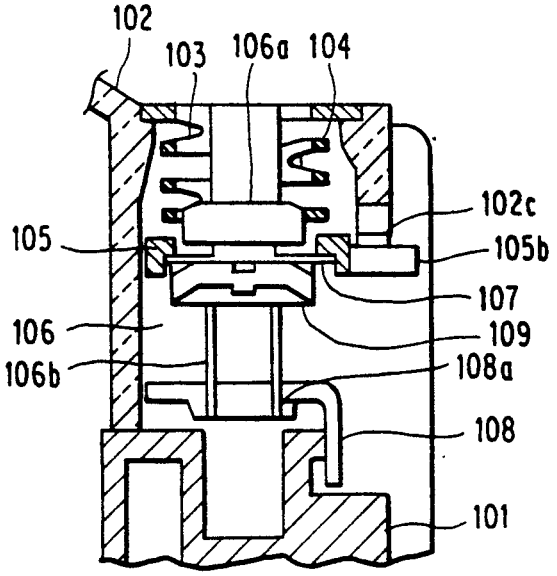
FIG. 4 is a fragmentary, sectional, front view similar to FIG. 1, particularly illustrating that an engagement portion on a side wall is engaged with an engaged portion on a terminal screw guiding member.

FIG. 4 is a fragmentary, sectional, front view of the terminal connecting device of the present invention, particularly illustrating the forked rod 105*b* of the terminal screw guiding member 105 in engagement with the projection 102*c* of the cover 102.

As long as the projection 102*c* is engaged with the forked rod 105*b*, since the lowermost end of the male-threaded portion 106*b* of the terminal screw 106 is located next to or in the vicinity of the uppermost end of the female-threaded hole 108*a*, a fastening or connection operation is easily performed with an open end type crimp terminal or a naked connection wire having no terminal. By way of contrast, when the projection 102*c* is disengaged from the forked rod 105*b*, a fastening or connection operation is easily performed with a round type crimp terminal.

Figure 5:
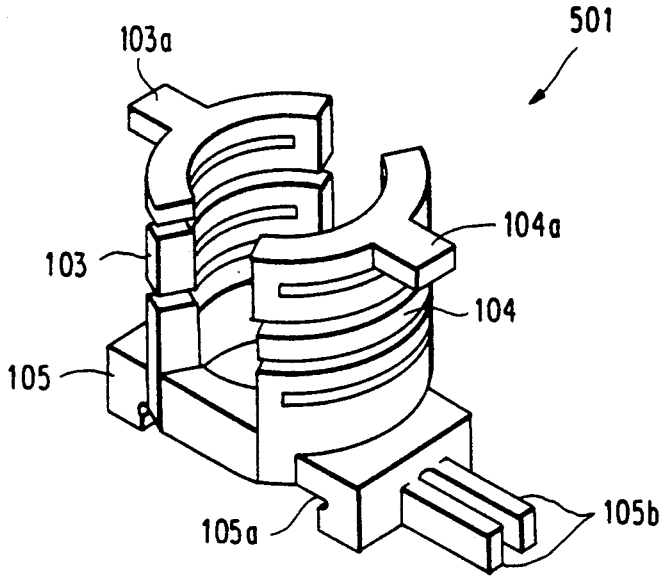
FIG. 5. is a fragmentary, perspective view of the terminal connecting device shown in FIG. 1, particularly illustrating the structure of a terminal screw guiding unit for the terminal connecting device.

FIG. 5 is a perspective view of the terminal connecting device, particularly illustrating the structure of a terminal screw guiding unit 501 including the springs 103, 104 and the terminal screw guiding member 105.

Typically, the springs 103, 104 and the terminal screw guiding member 105 are formed, respectively, of a metallic material. However, they may be molded of an electrical insulating material such as a synthetic resin or the like.

Figure 6:
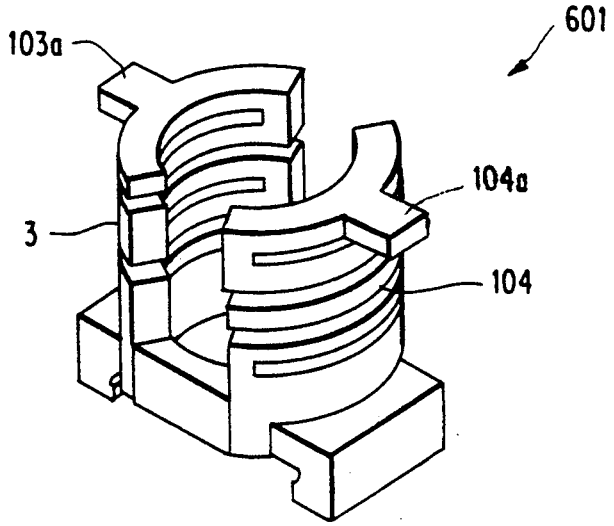
FIG. 6 is a fragmentary, perspective view of a terminal connecting device in accordance with a second embodiment of the present invention, particularly illustrating a terminal screw guiding unit for the terminal connecting device.

FIG. 6 is a fragmentary, perspective view of a terminal connecting device in accordance with a second embodiment of the present invention, particularly illustrating the structure of a terminal screw guiding unit 601 including zigzag-shaped springs 103, 104 and a terminal screw guiding member 105 wherein the forked rod 105*b* on the terminal screw guiding member 105, as shown in FIG. 5, is removed. In this embodiment, other components may be employed which function in the same manner as those described above with respect to the first embodiment of the present invention. For example, the terminal screw guiding member 105 may be retained in place by force applied by one's hand or simply by friction created between walls of the cover.

Figure 7:
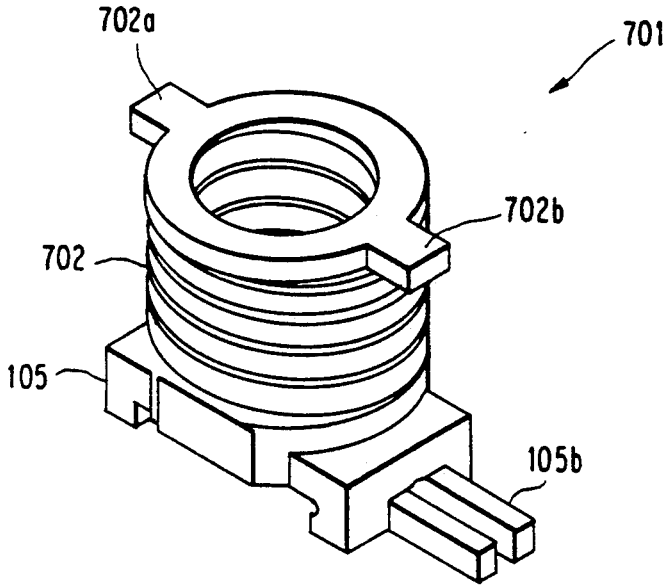
FIG. 7 is a fragmentary, perspective view of a terminal connecting device in accordance with a third embodiment of the present invention, particularly illustrating the structure of a terminal screw guiding unit for the terminal connecting device.

FIG. 7 is a perspective view of a terminal connecting device in accordance with a third embodiment of the present invention wherein a single coil spring 702 is substituted for the springs 103 and 104 for the terminal screw guiding unit 501 shown in FIG. 5. With a terminal screw guiding unit 701, as shown in FIG. 7, the same advantageous effects as those derived from the first embodiment of the present invention are obtainable.

In the foregoing embodiments, the springs 103, 104 and the terminal screw guiding member 105 may be separately fabricated and assembled together. Alternatively, they may be integrally molded from a synthetic resin. In that more preferable construction, designated the fourth embodiment of the invention, production costs are reduced significantly.

With the terminal connecting device as constructed in each of the first through fourth embodiments of the present invention, the terminal screw 106 is brought into engagement with the terminal screw guiding member 105 by fitting the outer peripheral edge of an engaging member, e.g., the washer 107, into the annular groove 105*a* of the terminal screw guiding member 105. However, the present invention should not be limited to this construction. For example, according to a fifth embodiment, the terminal screw 106 may be engaged with the terminal screw guiding member 105 with the same advantageous effects as mentioned above by engaging a projection provided on the terminal screw guiding member 105 with an annular groove formed around the outer peripheral edge of the washer 107.

For each of the first through fifth embodiments of the present invention, the terminal screw 106 is engaged with the terminal screw guiding member 105 via a washer 107. However, the present invention should not be limited to this construction. For example, according to a sixth embodiment, the terminal screw 106 may be engaged with the terminal screw guiding member 105, with the same advantageous effects as mentioned above, by engaging a projection or groove provided on the wire retainer 109 with a groove or projection provided on the terminal screw guiding member 105.

The terminal screw guiding member 105 constructed in accordance with the first through sixth embodiments may according to a seventh embodiment be rotatably engaged with the washer 107 or the wire retainer 109. In that case, when the terminal screw 106 is threadably tightened, the terminal screw guiding member 105 is prevented from receiving a rotational force due to the frictional forces existing between the terminal screw guiding member 105 and the washer 107 or the wire retainer 109. Thus, even where displacement of the terminal screw guiding member 105 is guided by the cover 102 and where the terminal screw guiding member 105 is not free to turn or rotate, the foregoing arrangement will prevent the terminal screw guiding member 105 and associated components from being damaged or broken as a result of forcible contact between the terminal screw guiding member 105 and the cover 102.

According to each of the first through seventh embodiments of the present invention, the terminal screw 106 is engaged with the terminal screw guiding member 105 via the washer 107 or the wire retainer 109. According to an eighth embodiment, the terminal screw 106 may also be engaged with the terminal screw guiding member 105, with the same advantageous effects as mentioned above, by engaging a projection or groove on the head portion 106*a* of the terminal screw 106 with a groove or projection provided on the terminal screw guiding member 105.

According to each of the first through eighth embodiments of the present invention, one end of the springs 103 and 104, or one end of the coil spring 702, is held by the cover 102 while the other end(s) are fixedly secured to the terminal screw guiding member 105. However, the present invention should not be limited to this construction. Alternatively, the other ends may be engaged with the terminal screw 106 so as to support both the terminal screw 106 and the terminal screw guiding member 105.

Figure 8:
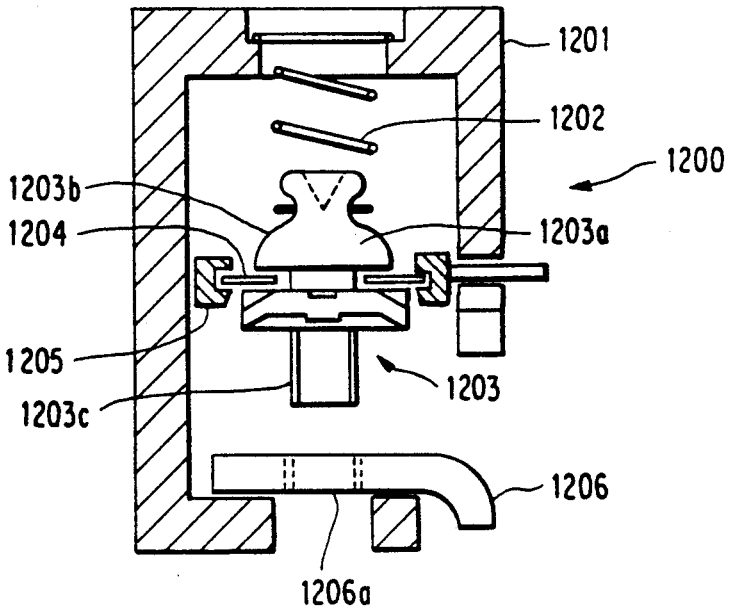
FIG. 8 is a fragmentary, sectional, front view of a terminal connecting device in accordance with a ninth embodiment of the present invention.

FIG. 8 is a fragmentary, sectional, front view of a ninth embodiment of the present invention. In this embodiment, one end of a coil spring 1202 is immovably held on a cover 1201 while the other end is rotatably fitted into an annular recess 1203*b* formed around a head portion 1203*a* of a terminal screw 1203, the terminal screw 1203 being suspended from the coil spring 1202 while a washer 1204, fixedly secured to the terminal screw 1203, is engaged with an annular groove formed in a terminal screw guiding member 1205 to thereby hold the terminal screw guiding member 1205.

As the terminal screw 1203 is displaced in the downward direction, as shown in FIG. 8, the displacement of the terminal screw 1205 is guided along a cover 1201 so that the lowermost end of a male-threaded portion 1203*c* of the terminal screw 1203 coincides with the uppermost end of a female-threaded hole 1206*a* of a stationary terminal 1206.

The terminal connecting device constructed in accordance with the ninth embodiment of the present invention, as shown in FIG. 8, exhibits the same advantageous effects as those of the first through eighth embodiments of the present invention.

As is apparent from the above description, a terminal screw is engaged with a terminal screw guiding member adapted to be displaced along a side wall, and the terminal screw or the terminal screw guiding member is supported with the aid of a resilient force derived from one or more elastic members of which one end is supported by the side wall so as to form a gap or a hollow space between the terminal screw and the female-threaded hole of a stationary terminal. With the terminal connecting device constructed as described above, as the terminal screw is displaced toward the female-threaded hole of the stationary terminal, the lowermost end of a male-threaded portion of the terminal screw is maintained in proper alignment with the uppermost end of the female-threaded hole of the stationary terminal. This results in remarkable improvements in the ease and efficiency of performing a fastening or connection operation.

In addition, when an engagement portion on the side wall is brought into engagement with an engaged portion on the terminal screw guiding member, the terminal screw can be held against the resilient force of the elastic member at the position where the male-threaded portion of the terminal screw abuts or is in close proximity to the female-threaded hole of the stationary terminal. Thus, while the foregoing engaged state is maintained, a fastening or connecting operation can be performed for the stationary terminal by inserting an open end type crimp terminal or a naked wire into the terminal connecting device. With respect to a round type crimp terminal, while the terminal connecting device is released from the foregoing engaged state, to thereby form a gap of predetermined width between the male-threaded portion of the terminal screw and the female-threaded hole of the stationary terminal, a fastening or connecting operation can be performed for the stationary terminal by inserting the round type crimp terminal into the gap or the hollow space as mentioned above. Consequently, a fastening or connecting operation is easily performed for a wide variety of different terminals.

Figure 12:
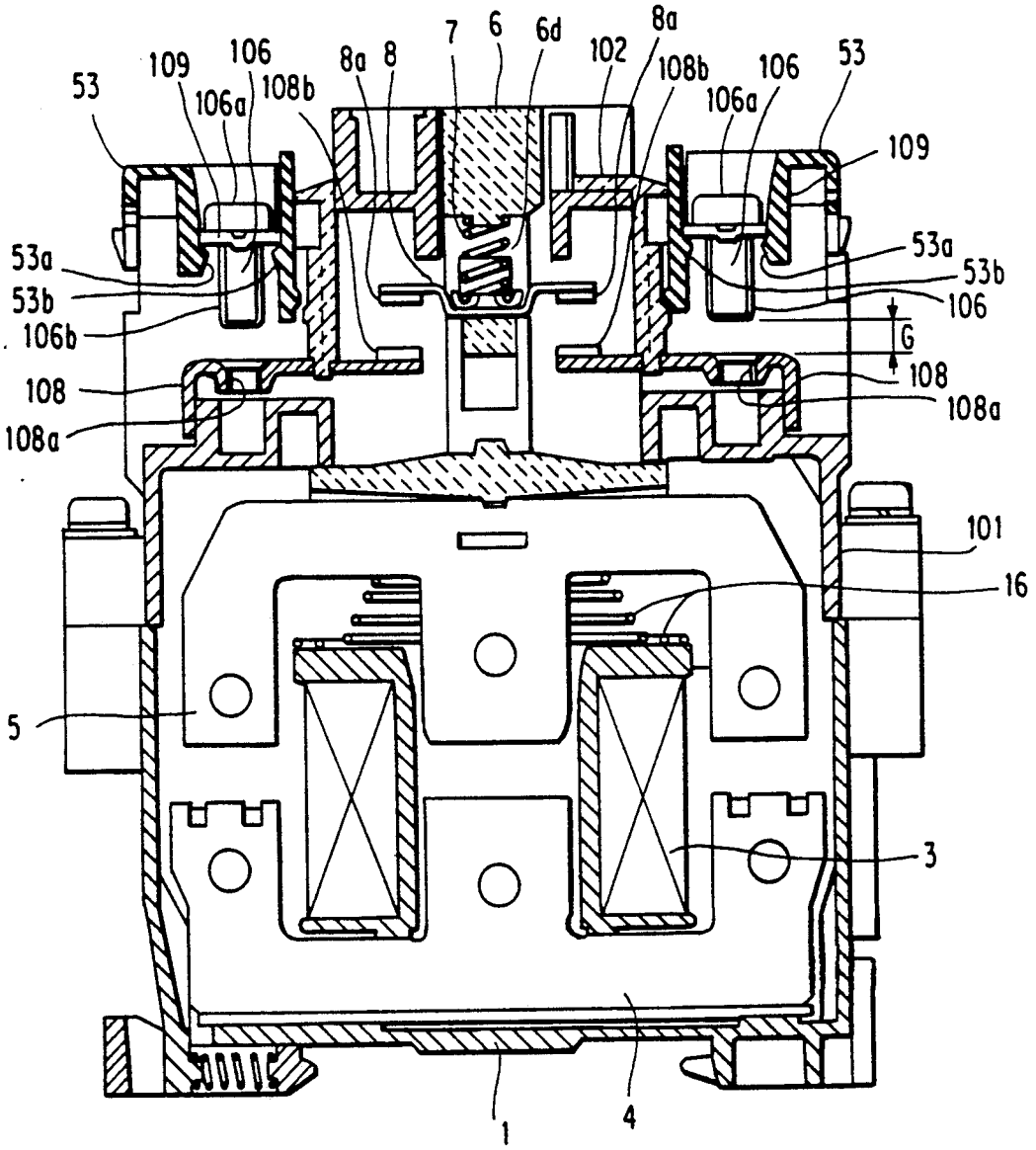
FIG. 12 is a sectional view (illustrating a first position) taken along the plane A—A of FIG. 13 which shows the top surface of a magnetic contactor and which relates to a tenth preferred embodiment of the present invention.
Figure 13:
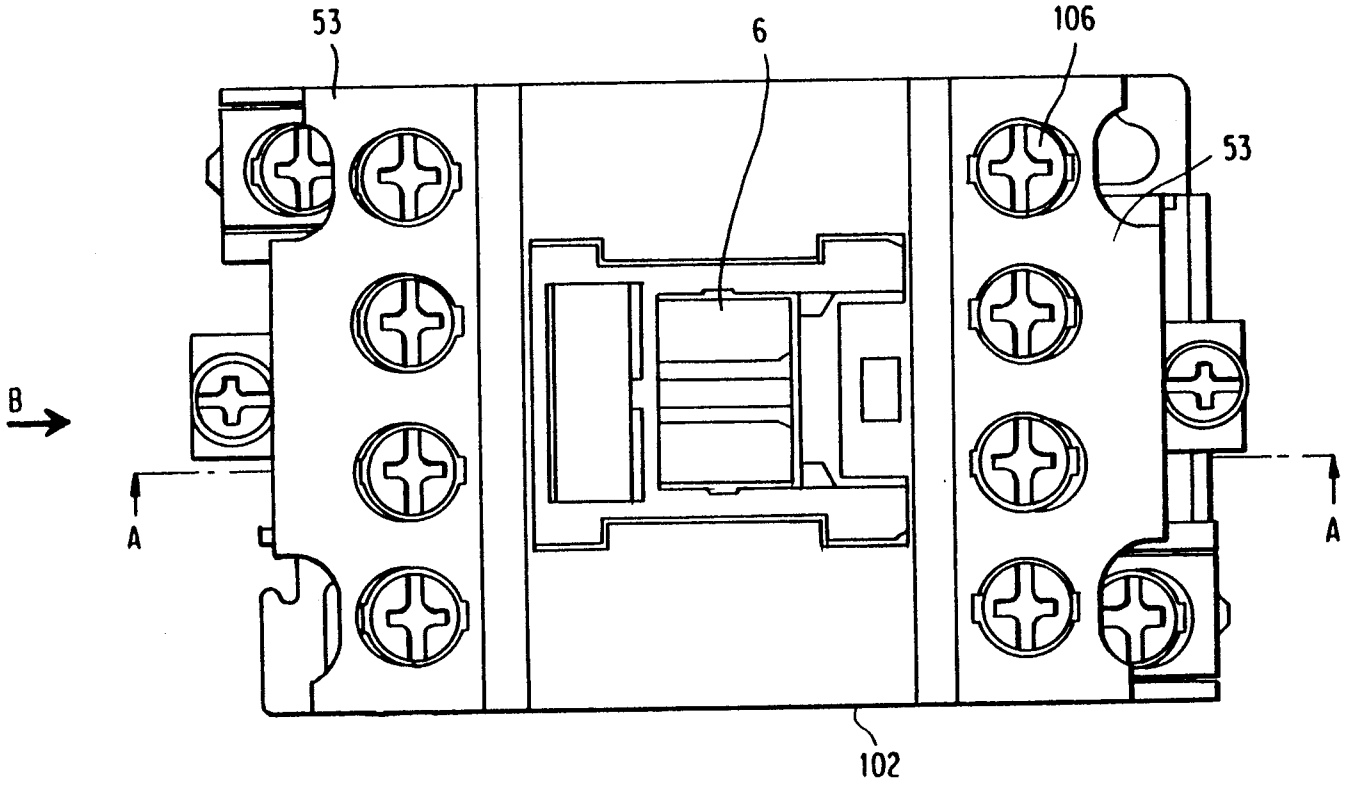
FIG. 13 is a plan view of the magnetic contactor of the tenth preferred embodiment of the present invention.
Figure 14:
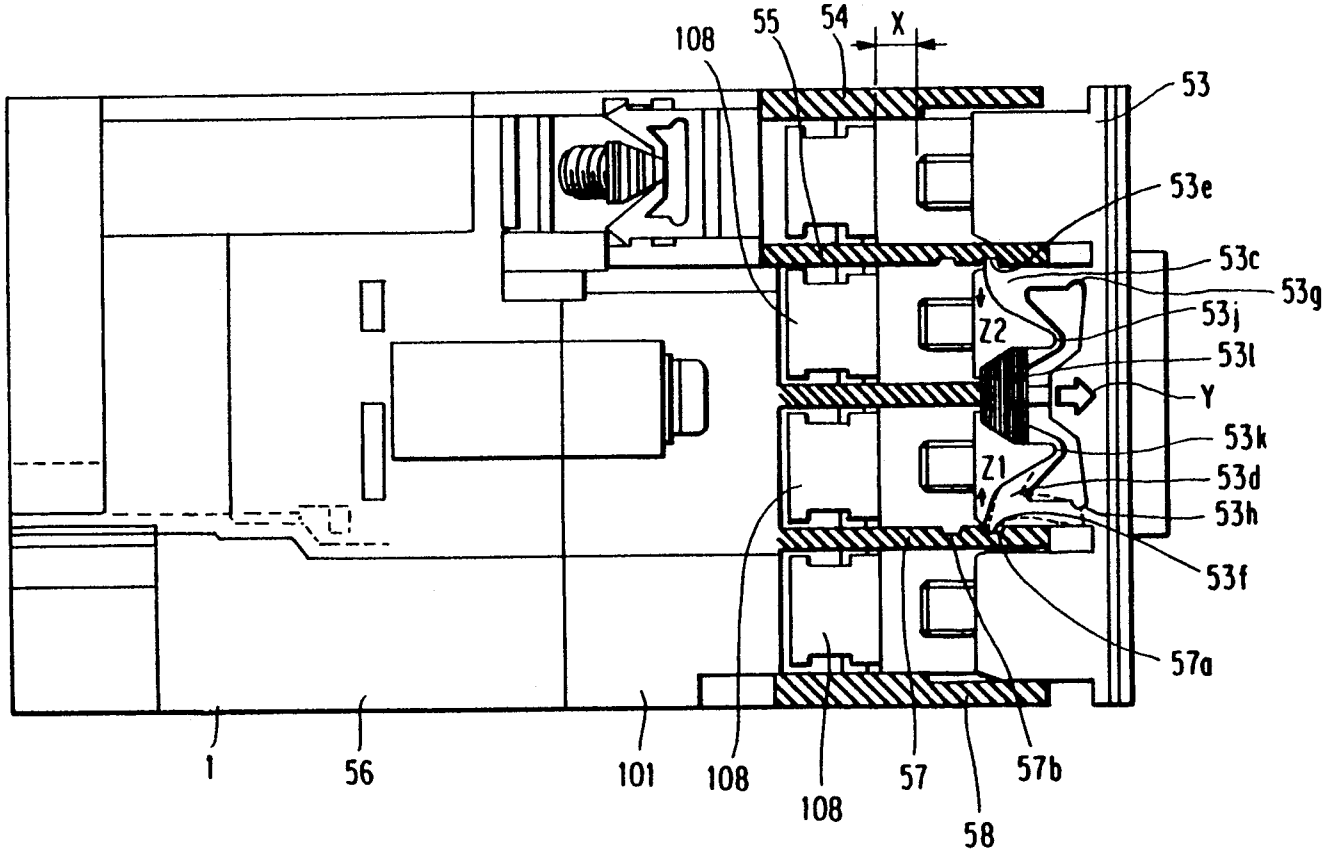
FIG. 14 is a view in the direction of arrow B in FIG. 13.
Figure 15:
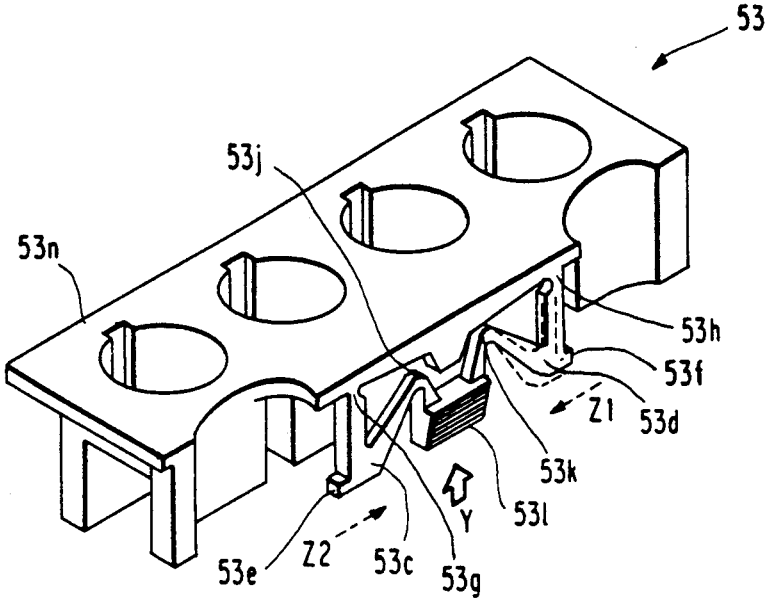
FIG. 15 is a perspective view of a holder of the tenth preferred embodiment of the present invention.
Figure 16:
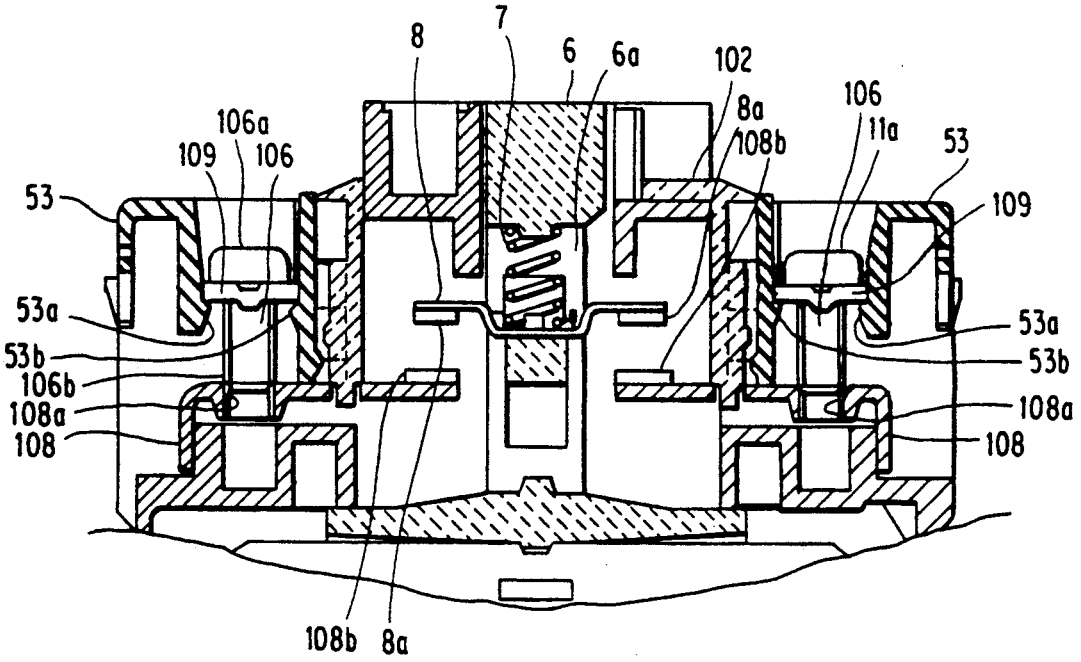
FIG. 16 illustrates the holder in a second position in which the terminal screw front end abuts on an internally threaded hole drilled in the terminal shown in FIG. 12.

Next, a tenth embodiment of the present invention will be described with respect to FIGS. 12–16. FIG. 13 is a plan view of a magnetic contactor which is just one example of an apparatus in which the following embodiments may be applied. FIG. 12 is a sectional view taken along the plane A—A of FIG. 13. FIG. 14 is a view in the direction indicated by arrow B in FIG. 13. FIG. 15 is a perspective view of a holder. FIG. 16 shows the holder in a second position which is a predetermined distance lower than the position shown in FIG. 12. In these drawings, reference numeral 1 indicates a mounting base, 101 a case, and 3 an exciting coil. Reference numeral 4 indicates a fixed core disposed opposite to a movable core 5, with a predetermined gap therebetween. Reference numeral 6 indicates a crossbar made of an insulating material and connected to said movable core 5. A top window 6*a* thereof retains a movable contactor 8 which is slidable in a vertical direction as is the crossbar 6 as shown in FIG. 12. Reference numeral 7 indicates a contact spring which is a compression coil spring providing for applying contact pressure to the movable contactor 8. 8*a* indicates movable contacts mounted at ends of the movable contactor 8 and disposed opposite to stationary contacts 108*b* with a predetermined contact gap in between. Stationary terminals 108 each include the stationary contact 108*b* joined at one end thereof and an internally threaded hole 108*a* bored in the opposite end. 102 indicates a cover for preventing arcs generated between the contacts from escaping. Reference numeral 16 indicates a tripping spring disposed for biasing the joint unit of the crossbar 6 and the movable core 5 upward in FIG. 13. The fundamental structure of the magnetic contactor is identical to that of the background art and need not be discussed further herein.

A cable presser 109 is assembled pivotally, as in the conventional art, to a terminal screw 106 provided to be threaded into the internally threaded hole 108*a* of the stationary terminal 108. 53 indicates a holder made of, for example, a thermoplastic resin, having elastic and insulative properties and shaped as shown in FIG. 15. Since the cable presser 109 is gripped by grippers 53*a* and 53*b* of the holder 53, the terminal screw 106 is pivotable with respect to the holder 53 and, since the grippers 53*a*, 53*b* are formed of an elastic material, the joint unit of the terminal screw 106 and the cable presser 109 is assembled loadably and unloadably in the axial direction of the screw 106 with respect to the holder 53.

As shown in FIG. 14, a pair of V-shaped engagement pieces 53*c* and 53*d* are formed in the front face of the holder 53. Engagement bosses 53*e* and 53*f* are formed at one corner of the V-shaped engagement pieces 53*c*, 53*d*, respectively. Ends 53*g*, 53*h* of the V-shaped engagement pieces 53*c*, 53*d* are joined to a holder body 53*z* and other ends thereof 53*j*, 53*k* are connected to a latch 53*l*.

Reference numerals 54, 55, 56, 57 and 58 in FIG. 14 indicate barriers formed on the case 101 and disposed to ensure electrical isolation for each phase of the 55*a*, 55*b*, 57*a*, 57*b* are disposed in the insides of the barriers 55, 57 for engagement with the engagement bosses 53*e*, 53*f* of the holder 53.

The opening and closing operations of the magnetic contactor will not be described herein as they are not the primary objective of the present invention and, in any event, are assumed to be conventional.

The wiring procedure of the terminal connecting device in the present embodiment will be described hereinafter. As above, it is assumed that there are three termination types of cable to be fastened or connected to the terminal of the present invention, i.e., a round solderless terminal, a naked wire or the like, and a beveled solderless terminal. First, the wiring of the round solderless terminal will be described. In FIG. 12, which shows the terminal screws 106 and the holders 53 in a first position, a gap of width "G" is provided between the front end of the terminal screw 106 and the stationary terminal 108. Since this gap is set to be considerably larger than the plate thickness "T" of the solderless terminal, the round solderless terminal can pass through the gap and be inserted into a position where it can be easily connected to the terminal screw 106. By threading the terminal screw 106, i.e., pressing a head 106*a* of the terminal screw 106 with a screwdriver, the cable presser 109 is released from the grippers 53*a*, 53*b*, the terminal screw 106 is moved downward as shown in FIG. 12, and the front end of the terminal screw 106 is inserted into the hole of the round solderless terminal and further threaded into the internally threaded hole 108*a*.

The wiring procedure of the wire or the beveled solderless terminal to the terminal connecting device of the present embodiment will now be described, particularly with reference to FIG. 16. In this case, in order to prevent the wire from entering and biting the internally threaded hole 108*a* of the stationary terminal 108, the holder 53 is lowered to a position where the front end of the terminal screw 106 abuts on the stationary terminal 108. That is, the holder 53 is moved downward from the position shown in FIG. 12, to a second position as shown in FIG. 16. This movement is achieved by holding down the latch 53*l* of the holder 53 in the direction of the arrow "Y" in FIG. 14 or FIG. 15 and pushing down the holder 53, i.e., the movement of the latch 53*l* in the direction of the arrow "Y" causes the V-shaped engagement pieces 53*c*, 53*d* to pivot on the ends 53*g*, 53*h* of the V shapes as indicated by the broken lines and the arrows Z1, Z2, the engagement bosses 53*e*, 53*f* of the holder 53 thereby being disengaged from the barrier grooves 55*a*, 57*a*, respectively. By pushing the holder 53 down, the engagement pieces 53*c*, 53*d* are returned to their original states due to the elasticity of the holder material, which then causes the engagement bosses 53*e*, 53*f* of the holder 53 to be engaged with the barrier grooves 55*b*, 57*b*, and the holder 53 and the terminal screw 106 to be fastened with the front end of the terminal screw 106 abutting on, or slightly entering the internally threaded hole 108*a*. By inserting the wire or the beveled solderless terminal under the cable presser 109 in said engagement state, i.e., in the second position, and tightening the terminal screw 106, the wiring is completed. At this point in time, the joint unit of the terminal screw 106 and the cable presser 109 is released from the grippers 53*a*, 53*b* of the holder 53 and threaded into the internally threaded hole 108*a* of the stationary terminal 108 as described previously in the wiring of the round solderless terminal.

To return from the second position in FIG. 16 to the upper position (first position) in FIG. 12, the engagement bosses 53*e*, 53*f* are simply disengaged from the barrier grooves 55*b*, 57*b* by moving the latch 53*l* in the direction of the arrow "Y" in FIG. 14 or FIG. 15 while simultaneously moving the holder 53 upward.

To return from the state wherein the terminal screw 106 is threaded in the stationary terminal 108 to the state wherein it is gripped by the holder 53, e.g., to change the wiring, etc., the terminal screw 106 may simply be removed (unscrewed) which automatically engages the cable presser 109 with the grippers 53*a*, 53*b*. (The dimensions have been set to provide automatic engagement).

Figure 17:
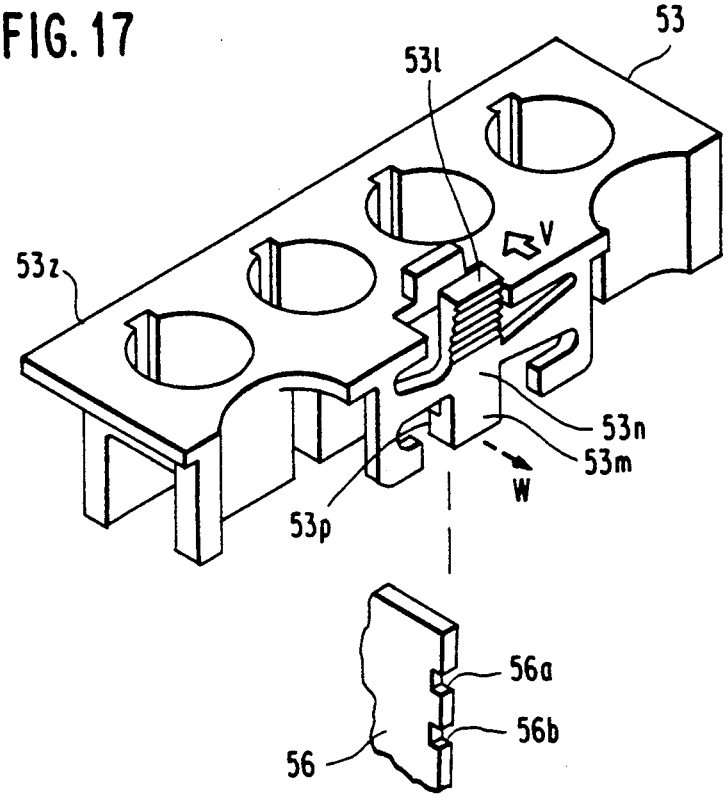
FIG. 17 is a perspective view of a holder of an eleventh preferred embodiment of the present invention.

FIG. 17 is a perspective view of a holder of an eleventh embodiment of the present invention. The general arrangement of the present embodiment will not be described herein since it is identical to that of the tenth lo embodiment described above except with respect to the holder 53 shown in FIG. 17. Referring to FIG. 17, 53 indicates a holder for gripping terminal screws (not shown), cable pressers (not shown), etc., as described in the tenth embodiment. The front face of the holder 53 is provided with a laminar engagement piece 53*m* which is joined to a holder body 53*z* of the holder 53 at a center 53*n* thereof. Also, an engagement boss 53*p* is formed at the bottom and a latch 53*l* at the top of the engagement piece 53*m*. Barrier grooves 56*a* and 56*b* engaged with the engagement boss 53*p* are formed in a center barrier 56, as shown in FIG. 17.

Wiring procedures are described hereinafter. In FIG. 17, the engagement boss 53*p* is engaged with the barrier groove 56*a* in a first position, i.e., a state compatible with the wiring of the round solderless terminal, and the engagement boss 53*p* is engaged with the barrier groove 56*b* in a second position, i.e., a state compatible with the wiring of the naked wire or the like and the beveled solderless terminal. To move the holder 53 between the first and second positions described above, the engagement boss 53*p* is simply disengaged from the groove 56*a* or 56*b* by moving the latch 53*l* in the direction of the arrow "V" shown in FIG. 17 while simultaneously moving the holder 53 upward or downward. That is, the movement of the latch 53*l* in the direction of the arrow "V" causes the engagement piece 53*m* to be flexibly pivoted about the center 53*n* connected to the holder body 53*z*, and the engagement boss 53*p* to move in the direction of the arrow "W" in FIG. 17, thereby accomplishing the disengagement. When the latch 53*l* is then moved in the direction opposite to the arrow "V", the engagement piece 53*m* is restored to its original shape due to the elasticity of the holder 53 material, thereby engaging the other groove. Other operations, such as screw tightening, are identical to those of the tenth embodiment described above.

Figure 18:
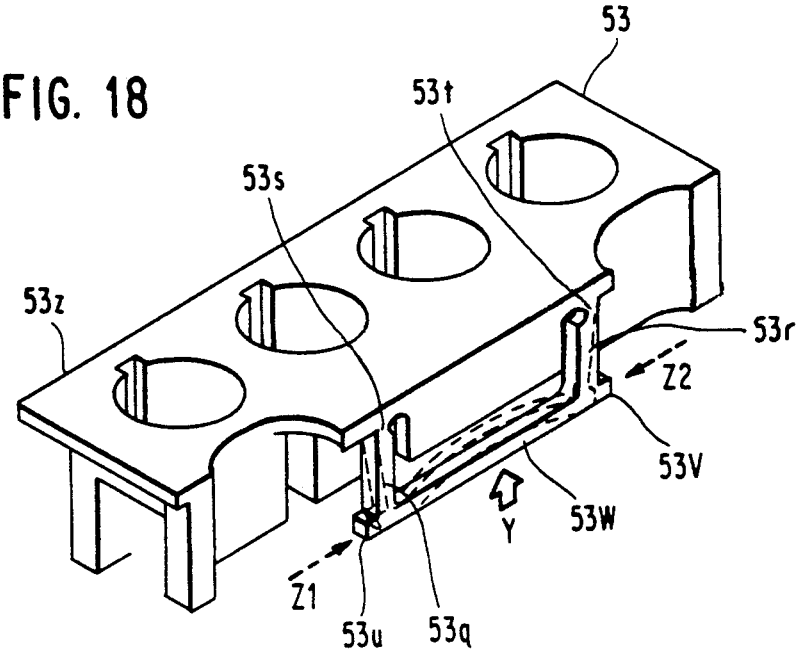
FIG. 18 is a perspective view of a holder of a twelfth preferred embodiment of the present invention.

FIG. 18 is a perspective view of a holder of a twelfth embodiment of the present invention. The general arrangement of the present embodiment will not be described herein since it is identical to that of the tenth and eleventh embodiments described above, except for the construction of the holder shown in FIG. 18. In FIG. 18, reference numeral 53 indicates a holder for gripping terminal screws (not shown), cable pressers (not shown), etc., as in the tenth and eleventh embodiments. In the front face of the holder 53, a pair of cantilever engagement pieces 53*q*, 53*r* are provided with cantilever bases 53*s*, 53*t* being connected to the holder body. Also, their cantilever ends are provided with engagement bosses 53*u*, 53*v* for engagement with the grooves 55*a*, 55*b*, 57*a*, 57*b*, etc., as shown in FIG. 14, and are further linked by a flexible bar 53*w*.

Wiring procedures are described hereinafter. In FIG. 18, the movement of a center portion of the flexible bar 53*w* in the direction of the arrow "Y" causes the bar 53*w* and the engagement pieces 53*q*, 53*r* to be transformed as indicated by the broken line, and the engagement bosses 53*u* and 53*v* to move in the directions of the arrows Z1 and Z2, respectively. This disengages the engagement pieces 53*u*, 53*v* from the barrier grooves 55*a*, 57*a* or the grooves 55*b*, 57*b*. In this disengaged state, the holder 53 can be moved upward or downward to the first or second positions. The other operations such as screw tightening are identical to those of the previous embodiments.

Figure 19:
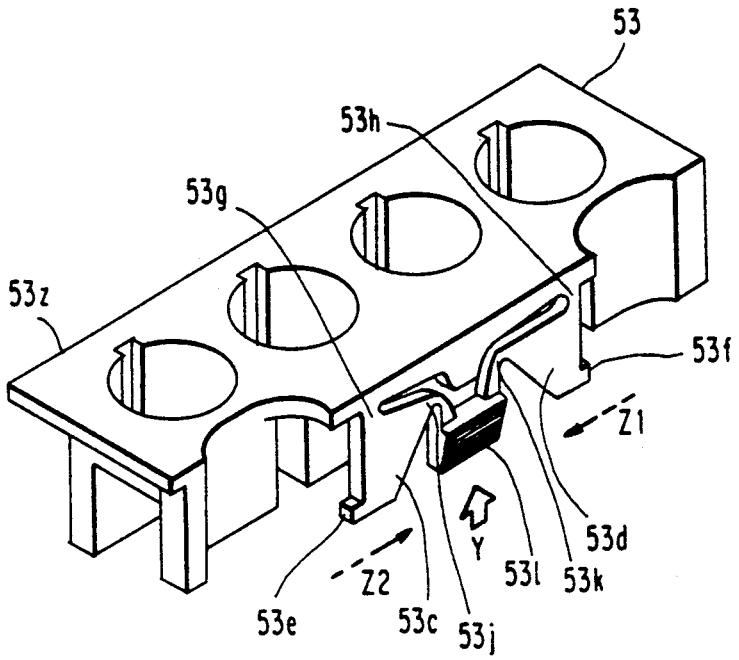
FIG. 19 is a perspective view of a holder of a thirteenth preferred embodiment of the present invention.

FIG. 19 is a perspective view of a holder of a thirteenth embodiment of the present invention. The arrangement of the present embodiment will not be described in detail herein since it is identical to that of the tenth through twelfth embodiments except for the construction of the holder as shown in FIG. 19. In FIG. 19, 53 indicates a holder gripping terminal screws (not shown), cable pressers (not shown), etc., as in the previous embodiments. In the front face of the holder 53, a pair of nearly triangular engagement pieces 53*c*, 53*d* are formed. On first corners of the nearly triangular pieces, engagement bosses 53*e*, 53*f* are formed for engagement with the barrier grooves 55*a*, 57*a* or 55*b*, 57*b* in FIG. 14, and second corners 53*g*, 53*h* are joined in a body 53*z* of the holder 53. Third corners 53*j*, 53*k* are connected with a latch 53*l*.

Wiring procedures are described hereinafter. As described previously with respect to the tenth embodiment, the movement of the latch 53*l* in the direction of the arrow "Y" causes the engagement pieces 53*c*, 53*d* to pivot on the corners 53*g*, 53*h* in the directions of the arrows Z1, Z2, respectively, thereby disengaging the engagement bosses 53*e*, 53*f* from the barrier grooves 55*a*, 57*a* or the grooves 55*b*, 57*b*. The subsequent operations are identical to those described above.

Figure 20:
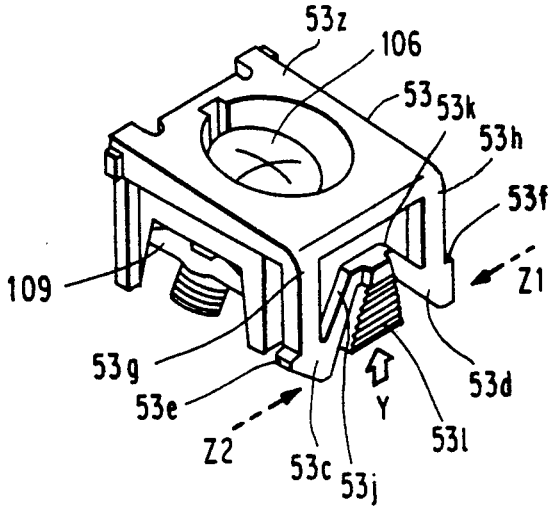
FIG. 20 is a perspective view of a holder of a fourteenth preferred embodiment of the present invention.

FIG. 20 is a perspective view of a holder of a fourteenth embodiment of the present invention. While the apparatus of the tenth embodiment grips terminal screws and cable pressers for a plurality of poles, the fourteenth embodiment relates to an apparatus which is designed to include a terminal screw and a cable presser for each pole. That is, a holder 53 grips a terminal screw 106 and a cable presser 109 for a single pole, and a pair of V-shaped engagement pieces 53*c* and 53*d* are formed in the front face thereof. Engagement bosses 53*e* and 53*f* are formed at the crossings of the V shapes of the engagement pieces 53*c*, 53*d*. Ends 53*g*, 53*h* of the V shapes are connected to a holder body 53*z* and other ends thereof 53*j*, 53*k* are joined to a latch 53*l*. The holder 53 shown in FIG. 20 is disposed in each pole.

The wiring procedures of the fourteenth embodiment are omitted because they are identical to those described above except that the wiring is conducted for each individual pole.

In the fifteenth embodiment, the terminal screw 106 retained by the holder 53 via the cable presser 109, as in the tenth to fourteenth embodiments, is retained in a manner as described in the first, fifth, sixth and eighth embodiments.

Figure 21:
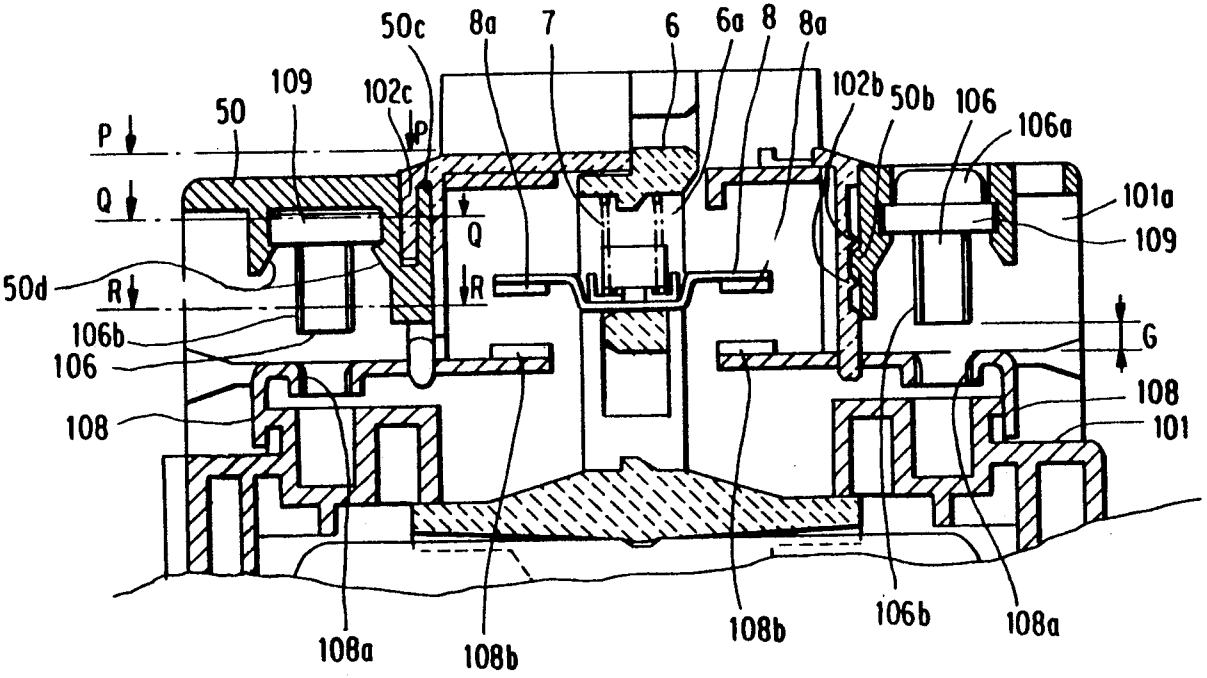
FIG. 21 is a sectional view illustrating the top section of a magnetic contactor which relates to a sixteenth preferred embodiment of the present invention.
Figure 22:
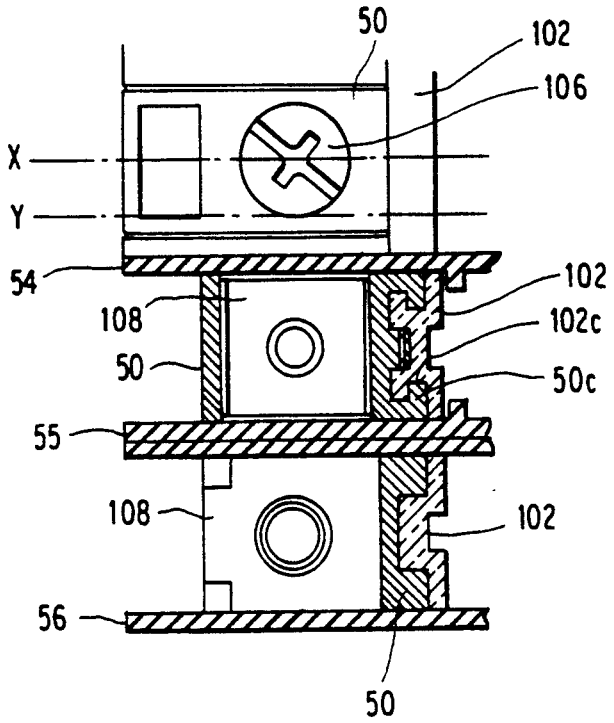
FIG. 22 is a sectional view taken along the planes P—P, Q—Q and R—R of the terminal section shown in FIG. 21.
Figure 23A:
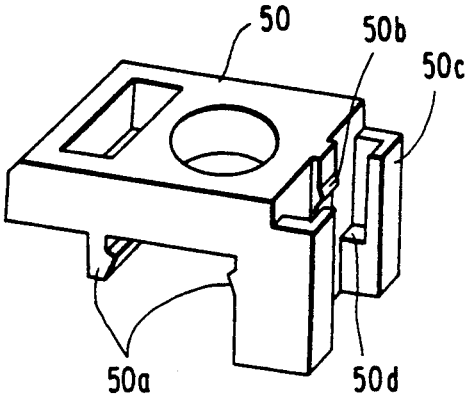
FIGS. 23(*a*)-23(*b*) are perspective view of a terminal screw holder and a cover adjacent to the terminal section shown in FIG. 21.
Figure 23B:
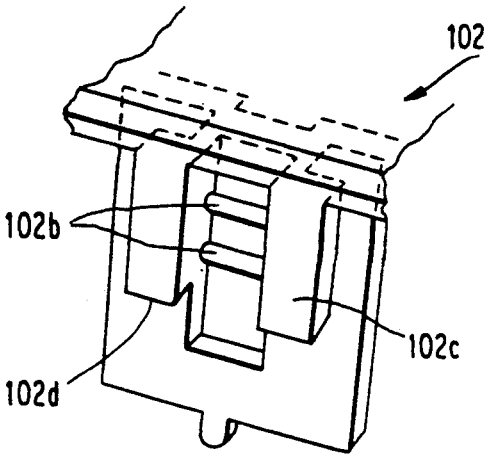

A sixteenth embodiment of the present invention will now be described with reference to FIGS. 21 to 23. FIG. 21 is a sectional view of the top section of a magnetic contactor showing the cross section of the terminal section taken along the plane "Y" of FIG. 22, on the left-hand side, with the cross section thereof taken along the plane "X", on the right-hand side. FIG. 22 is a sectional view of the terminal section in FIG. 21 taken along the planes P—P, Q—Q and R—R from top to bottom, respectively. FIG. 23 is a perspective view of a terminal screw holder and a cover adjacent to the terminal section shown in FIG. 21.

In the above mentioned drawings, reference numeral 50 indicates a terminal screw holder which is slidable in the vertical direction along the cover 102, the holder 50 having two stable positions and being formed of thermoplastic or the like for insulative and elastic properties. Reference numeral 50*a* indicates grippers for gripping a cable presser 109, reference numeral 50*b* a positioning projection which enters a recess provided by positioning projections 102*b* of the cover 102, or the fitting portion with the cover 102, for creating the stable position, and 50*c* a sliding projection which fits into a recess created by a sliding projection 102*c* of the cover 102, or the fitting portion of the cover 102. When a terminal screw 106 is retained by the terminal screw holder 50 as shown in FIG. 21, the terminal screw 106 is pivotable, and the holder 50 has a hole into which a screwdriver or other tool (not shown) for threading the terminal screw 106 is inserted.

The two lower poles of FIG. 22 show the cross sections of the terminal screw holder 50 and the cover 102, wherein the sliding projections 102*c* and 50*c* are slidably interconnected or meshed. Also, as shown in FIG. 23, a contact surface 50*d* of the terminal screw holder 50 abuts a contact surface 102*d* of the cover 102 to thereby prevent the terminal screw holder 50 from being removed from the cover 102. The terminal screw holder 50 is provided with two stable positions in the sliding direction by the positioning projections 102*b* of the cover 102 and the positioning projection 50*b* of the holder 50. In the first position, a gap is provided between the front end of the terminal screw 106 and a stationary terminal 108 having an internally threaded hole 108*a*. In the second position, the front end of the terminal screw 106 abuts or is in close proximity to the internally threaded hole 108*a* of the stationary terminal 108. The above described sliding and positioning portions are provided within the deep recesses of the terminal section.

In the present embodiment, the sliding projection 102*c* and the contact surface 102*d* constitute a holder mounting section.

The wiring procedures of the terminal in the embodiment shown in FIGS. 21–23 are described hereinafter.

Being identical to those of the prior art, the opening and closing operations of the magnetic contactor will not be described.

It is assumed that there are three termination types of cable, as described above, a round solderless terminal, a wire and a beveled solderless terminal. First, the wiring of the round solderless terminal will be described. In FIG. 21, which shows the terminal screws 106 and holders 53 in the first position, a gap "G" is provided between the front end of the terminal screw 106 and the stationary terminal 108. Since this gap is set to be at least larger than the plate thickness "T" of the solderless terminal, the round solderless terminal can pass through the gap and into the proper alignment with the terminal screw 106. The terminal screw holder 50 may then be slid by hand or with a screwdriver to the second position (where the front end of the terminal screw 106 abuts on the stationary terminal 108), the front end of the terminal screw 106 then being inserted into the hole of the round solderless terminal. After that, the terminal screw 106 may be threaded into the internally threaded hole 108*a*. This completes the wiring procedure.

The wiring procedures for the naked wire or beveled solderless terminal to the terminal connecting device of the present embodiment are described hereinafter. In this case, in order to prevent the wire from entering and biting the internally threaded hole 108*a* of the stationary terminal 108, the terminal screw holder 50 is lowered into a position where the front end of the terminal screw 106 abuts on the stationary terminal 108, i.e., the terminal screw holder 50 is moved downward from the state of FIG. 21, whereby it is set to the second position shown in FIG. 26(*a*). In particular, by pushing the terminal screw holder 50, the terminal screw 106 connected thereto moves downward with the terminal screw holder 50 along the sliding portion of the cover 102. At this time, the projection 50*b* goes beyond one of the positioning projections 102*b* and settles in the second stable position where the front end of the terminal screw 106 abuts on or slightly enters the internally threaded hole 108*a*. By inserting the wire or the beveled solderless terminal under the cable presser 109 and tightening the terminal screw 106, the wiring procedure is completed.

When the product is set to the second position as, for example, before shipment, the naked wires or beveled solderless terminals can be pre-wired. For the wiring of the round solderless terminals, the movement of the terminal screw holder 50 retaining the terminal screw 106 to said first position allows the cable to be wired with little effort in a "hands off" manner.

Figure 24:
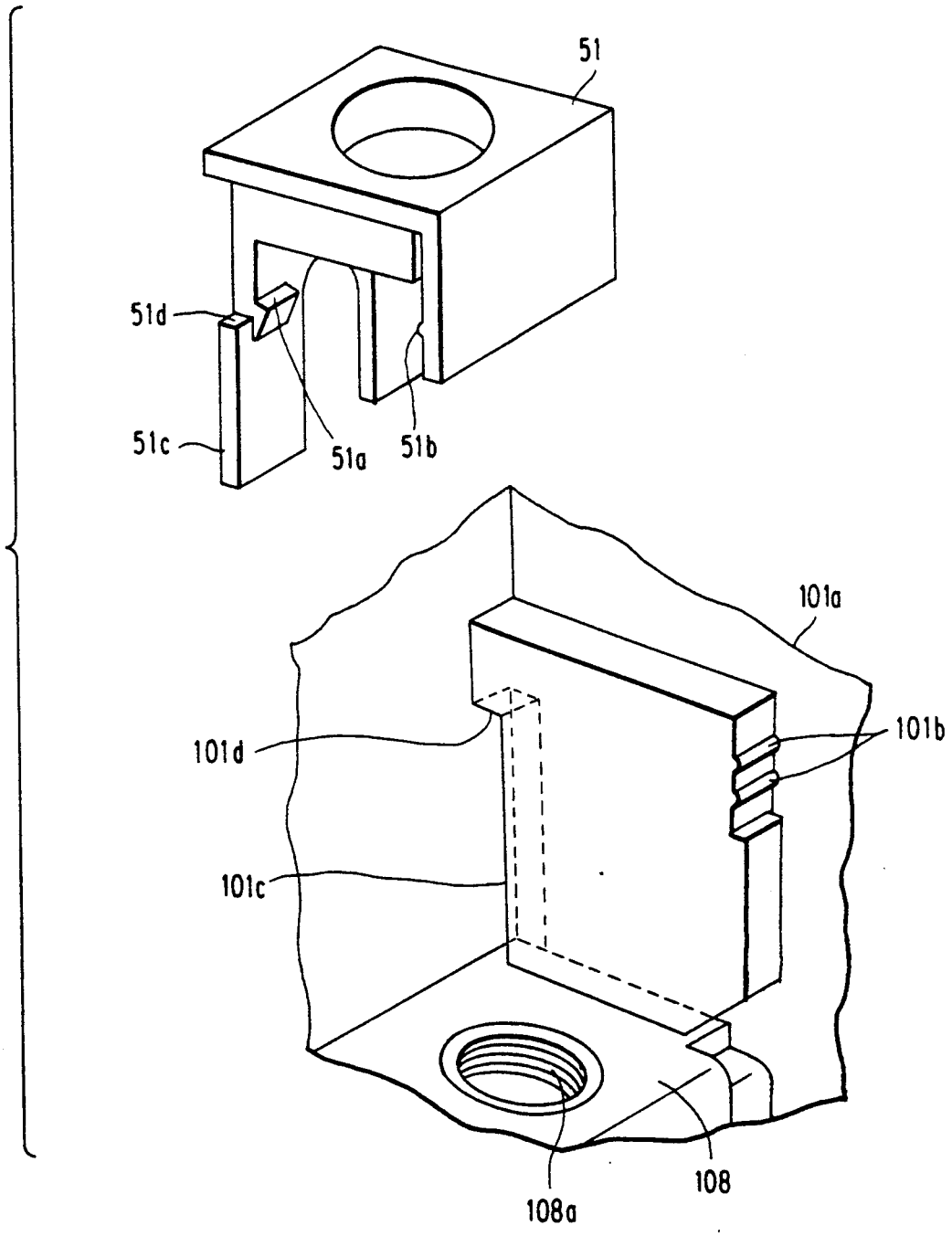
FIG. 24 is a perspective view illustrating the fitting of a terminal screw holder which relates to a seventeenth preferred embodiment of the present invention and which performs identical functions to the holder shown in FIG. 23.
Figure 25:
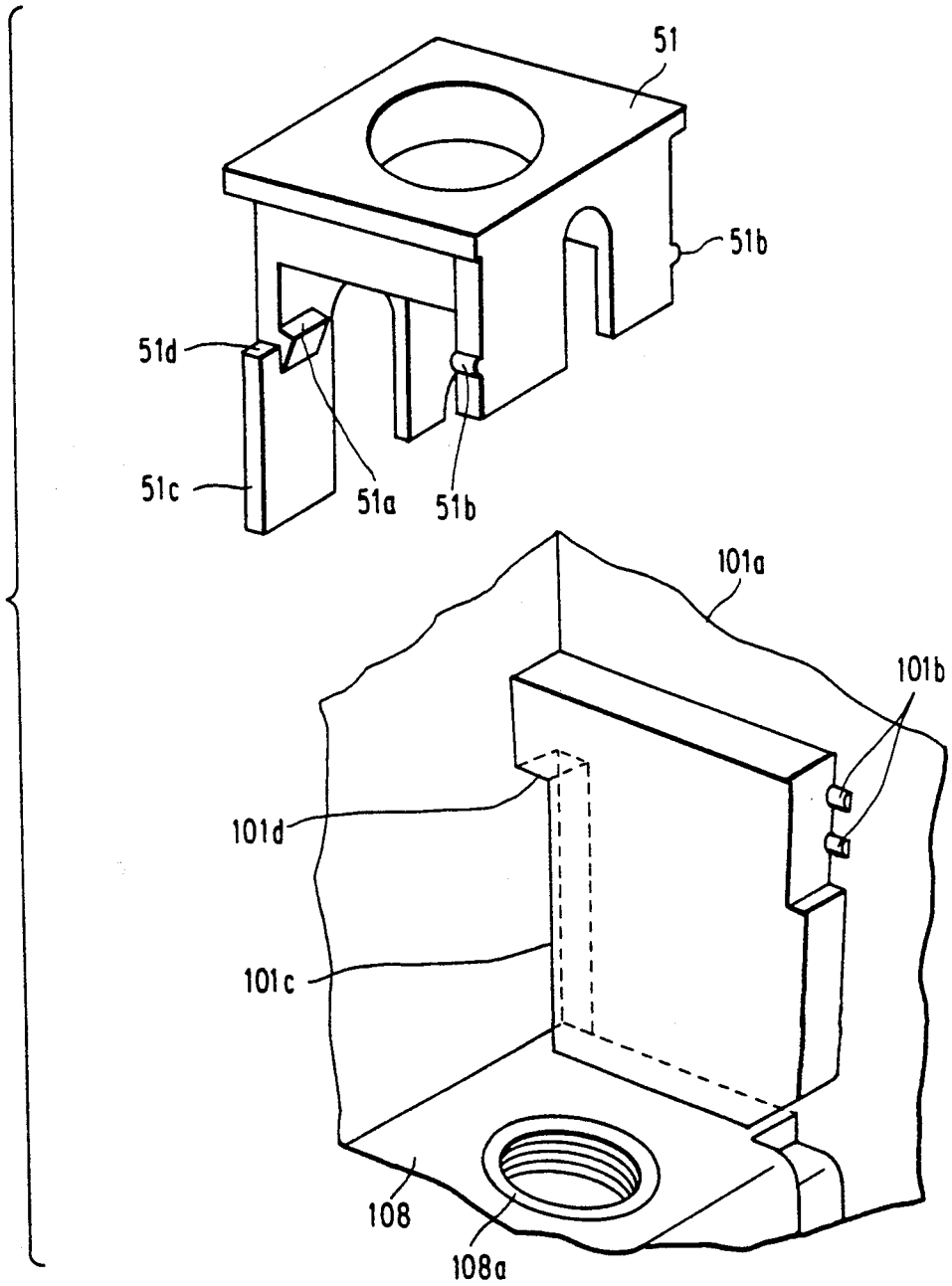
FIG. 25 is a perspective view illustrating the fitting of the terminal screw holder which relates to an eighteenth preferred embodiment of the present invention and which performs functions identical to the holder shown in FIG. 23.
Figure 26A:
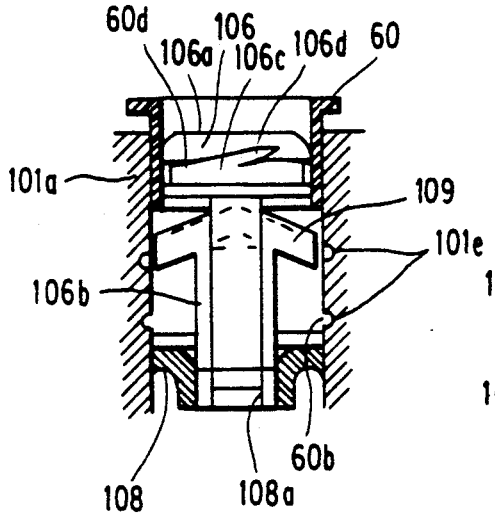
FIGS. 26(*a*)-26(*d*) illustrate the three stable positions of a terminal screw holder and relates to a nineteenth preferred embodiment of the present invention.
Figure 26B:
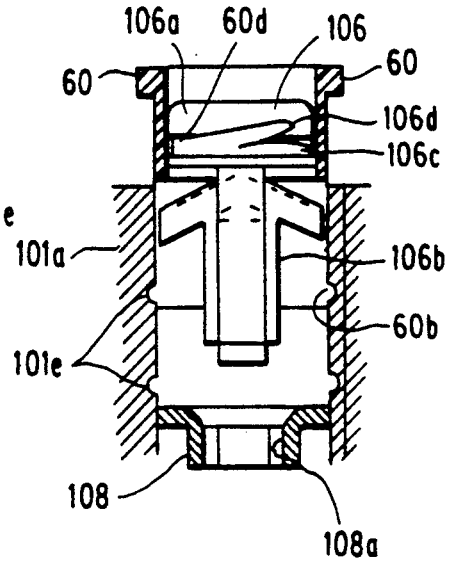
Figure 26C:
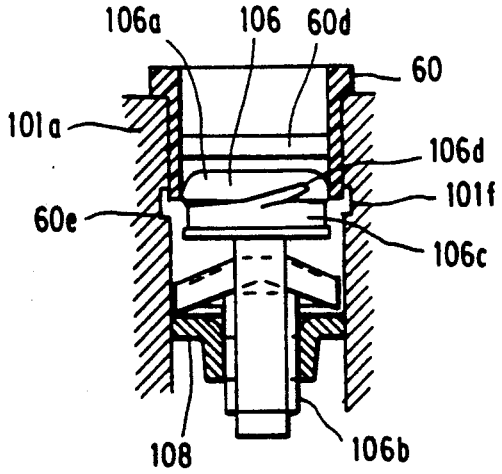
Figure 26D:
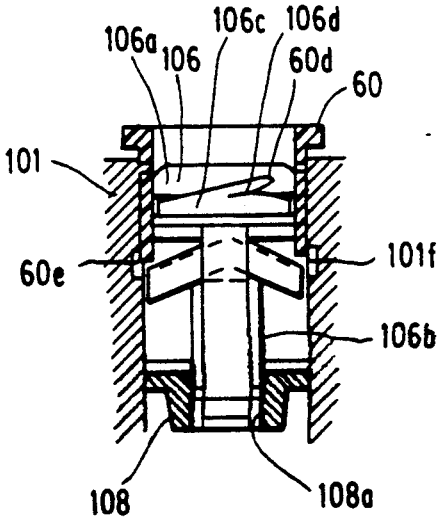

A seventeenth embodiment will now be described using FIGS. 24 and 25. The present embodiment functions identically to the embodiment shown in FIGS. 21-23, but is different in that the sliding portions and positioning portions are provided not on the cover 102 but rather on a case 101 between the poles or on a barrier 101*a* of the case 101. The numerals 51, 51*a*, 51*b*, 51*c* and 51*d* correspond to 50, 50*a*, 50*b*, 50*c* and 50*d* of FIG. 23. Reference numerals 101*b*, 101*c* and 101*d* correspond to reference numerals 102*b*, 102*c* and 102*d* of FIG. 23 provided on the case 101 or the barrier 101*a* of the case 101. With this construction, identical functions can be accomplished without the cover 102.

It should be noted that reference numerals 101*b*, 101*c* and 101*d* refer to both sides of the stationary terminal 108, although they are only shown on one side thereof.

The terminal screw 106 retained by the holder 50 via the cable presser 109 in the sixteenth and seventeenth embodiments may also be retained in a manner as described in the first, fifth, sixth and eighth embodiments.

A nineteenth embodiment having three stable positions for a terminal screw holder will now be described in accordance with FIGS. 26 and 27.

Figure 27A:
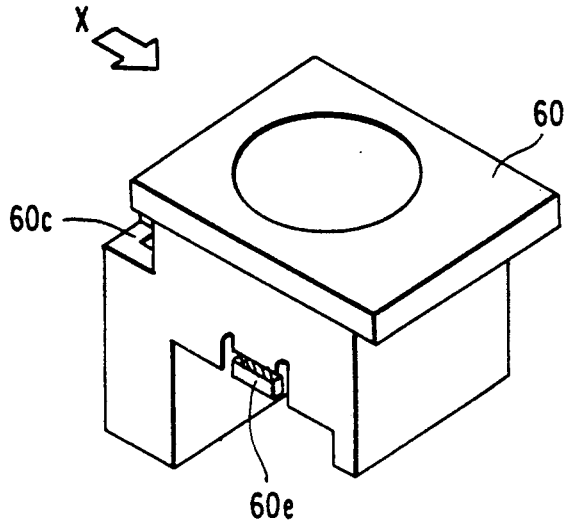
FIGS. 27(*a*)-27(*c*) are perspective views of a terminal screw holder and a terminal screw for which there are three stable positions as shown in the nineteenth preferred embodiment of the present invention.
Figure 27B:
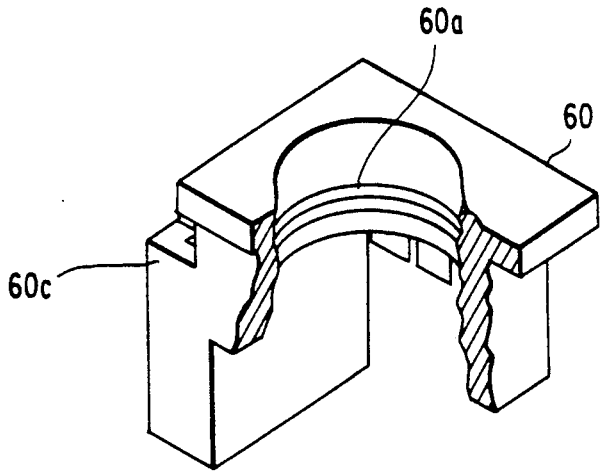
Figure 27C:
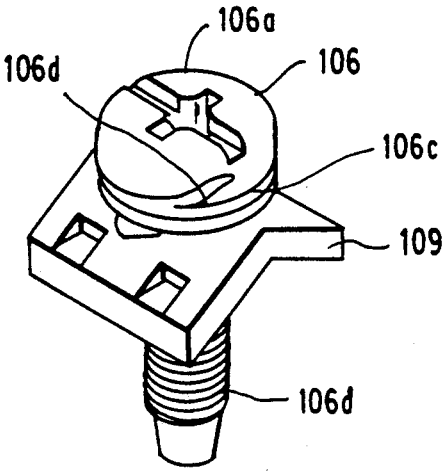

FIGS. 26(*a*)-26(*d*) show an operation principle diagram, FIG. 27(*a*) and (*b*) are perspective views of a terminal screw holder according to the present embodiment, and FIG. 27(*c*) is a perspective view of a terminal screw. In these drawings, 60 indicates a terminal screw holder made of thermoplastic or the like having insulative and elastic properties, 60*a* an annular retaining ledge, 60*b* a positioning ledge fit into positioning grooves 101*e* provided in a barrier 10*a* of a case 101 for establishing the first and second stable positions, 60*c* a sliding protrusion, 60*e* a positioning retainer fitted into a positioning groove 101*f* provided in the barrier 101*a* of the cover 101 for determining and retaining a third stable position, 106 a terminal screw, 106*c* an annular retaining groove provided in a head 106*a* of the terminal screw 106, fitted to the annular retaining ledge 106*a* formed on the terminal screw holder 60, and retained by the terminal screw holder 60, 106*d* a guide slit which permits the retaining groove 106*c* to fit into the retaining ledge 60*a* when the terminal screw 106 enters the terminal screw holder 60, and 109 a cable presser. In addition, since, when retained by the terminal screw holder 60, the terminal screw 106 is held by the annular retaining groove 106*c* provided in the head 106*a* of the terminal screw 106 and the annular retaining ledge 60*a* provided on the terminal screw holder 60, the terminal screw 106 is pivotable, easily inserted into the terminal screw holder 60, and retained firmly and securely.

FIG. 26(*a*) shows the second position described in FIGS. 21 to 23 where the front end of the terminal screw 106 abuts on or has slightly entered the internally threaded hole 108*a*, FIG. 26(*b*) the first position described in FIGS. 21 to 23 where a gap is provided between the front end of the terminal screw 106 and the stationary terminal 10, FIG. 26(*c*) a state wherein the terminal screw 106 has been tightened, and FIG. 26(*d*) a state wherein the retaining groove 106*c* has just fit to the retaining ledge 60*a* by loosening the terminal screw 106 in the state of FIG. 26(*c*), or wherein the terminal screw holder 60 has come to the third stable position by tightening the terminal screw 106 several turns from the state of FIG. 26(*a*). The positioning structure of the first and second positions of the terminal screw holder 60 is virtually identical to that shown in FIGS. 21 to 23.

Wiring procedures will be described hereinafter. FIGS. 26(*a*) and 26(*b*) will not be described because they have been explained with respect to the first and second positions.

When the terminal screw 106 is tightened in the state of FIG. 26(*a*), the large fitting force of the retaining groove 106*c* and the retaining ledge 60*a* causes the positioning ledge 60*b* to go beyond the positioning groove 101*e* provided in the barrier 101*a* of the case 101, and the terminal screw holder 60 to be lowered together with the terminal screw 106. When the terminal screw 106 is tightened several turns, the positioning gripper 60*e* fits into the positioning groove 101*f* as shown in FIG. 26(*d*), and at the same time, the terminal screw holder 60 comes into contact with the barrier 101*a* of the case 101 and is stopped at the third stable position. When the terminal screw 106 is further tightened, the extremely large thrust force of the screw causes the retaining groove 106c to be disengaged from the retaining ledge 60a, only the terminal screw 106 to move downward, and the screw to be fully tightened as shown in FIG. 26(*c*).

Conversely, when the terminal screw 106 is loosened in the state of FIG. 26(*c*), the retaining force of the positioning gripper 60e and the positioning groove 101f, which is designed to be greater than the fitting force of the positioning ledge 60b and the positioning groove 101e and also to be larger than the force required for the fitting of the retaining groove 106c and the retaining ledge 60a, causes the terminal screw holder 60 to stay in the third stable position until the retaining groove 106c fits onto the retaining ledge 60a, as shown in FIG. 26(*d*). When the terminal screw 106 is further loosened, the thrust force of the screw disengages the positioning gripper 60e from the positioning groove 101f as shown in FIG. 26(*a*). As described above, the installation and removal of the terminal screw 106 to and from the terminal screw holder 60 are rendered reproducible for the tightening and loosening operations of the screw. In addition, the provision of the guide slit 106d allows the terminal screw 106 to enter the terminal screw holder 60 more smoothly.

Figure 28:
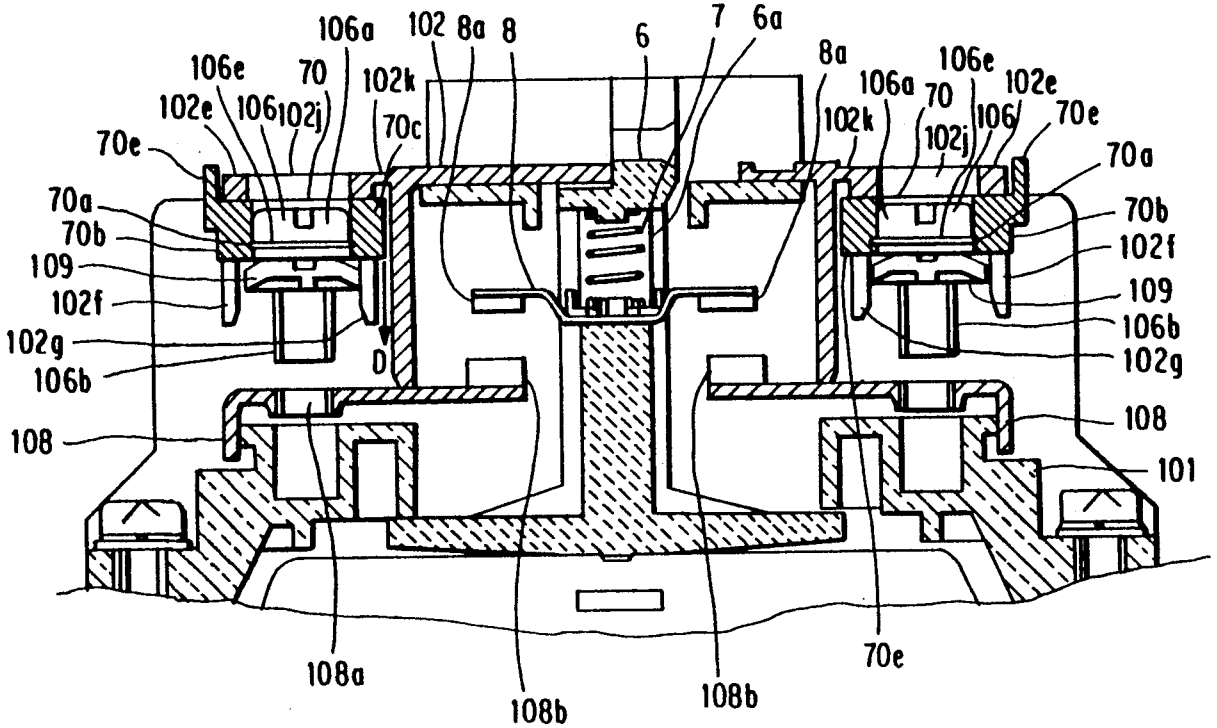
FIG. 28 is a sectional view (illustrating a first position) taken along the plane A—A of FIG. 29 which shows the top surface of a magnetic contactor and is a twentieth preferred embodiment of the present invention.
Figure 29:
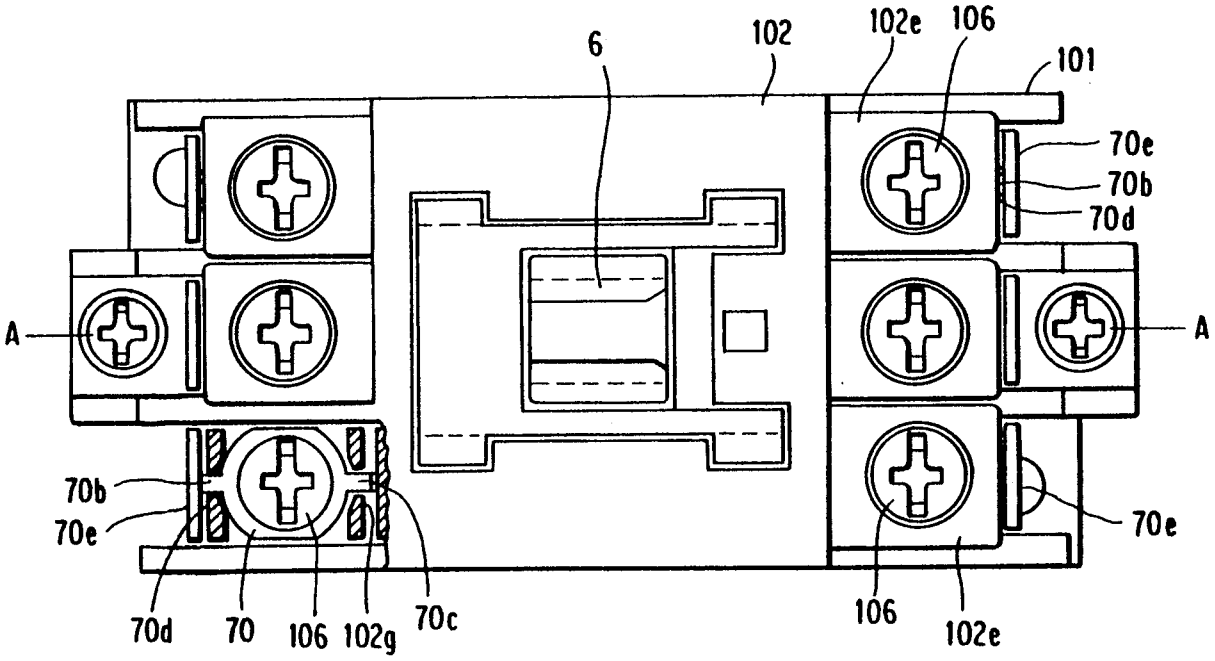
FIG. 29 is a plan view of the magnetic contactor which relates to the twentieth preferred embodiment of the present invention.
Figure 30:
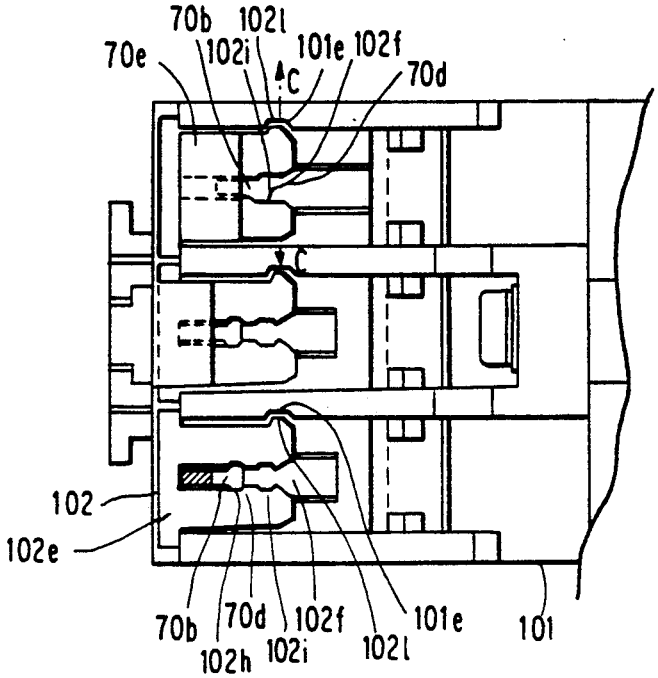
FIG. 30 is a view in the direction of the arrow B in FIG. 29, illustrating different positions of the terminal screw holder.

A twentieth embodiment of the present invention will now be described on the basis of FIGS. 28 to 32. FIG. 29 is a plan view of a magnetic contactor, and FIG. 28 is a sectional view taken along the plane A—A of FIG. 29, showing only the top section. FIG. 30 is a view seen in the direction of the arrow "B" in FIG. 29, FIG. 31 is a perspective view of a holder, and FIG. 29 shows a state wherein the holder has been moved to a position (second position), a predetermined distance lower than the position of FIG. 28.

In these drawings, a cable presser 109 is assembled pivotally, as in the prior art, to a terminal screw 106 disposed to be threaded into an internally threaded hole 108a of a stationary terminal 108. A ledge 106e for pivotable engagement with a holder 70 is provided on a screw head 106a. The holder 70 is made of a material, such as thermoplastic resin, having elastic and insulative properties, the terminal screw 106 including a recess 70a for retaining the terminal screw 106 pivotally, and the terminal screw 106 and the holder 70 being joined and fixed with the ledge 106e as, for example, by press-fitting, etc. A gap is provided between the terminal screw 106 and the holder 70 so that the terminal screw 106 is secured pivotally.

Figure 31:
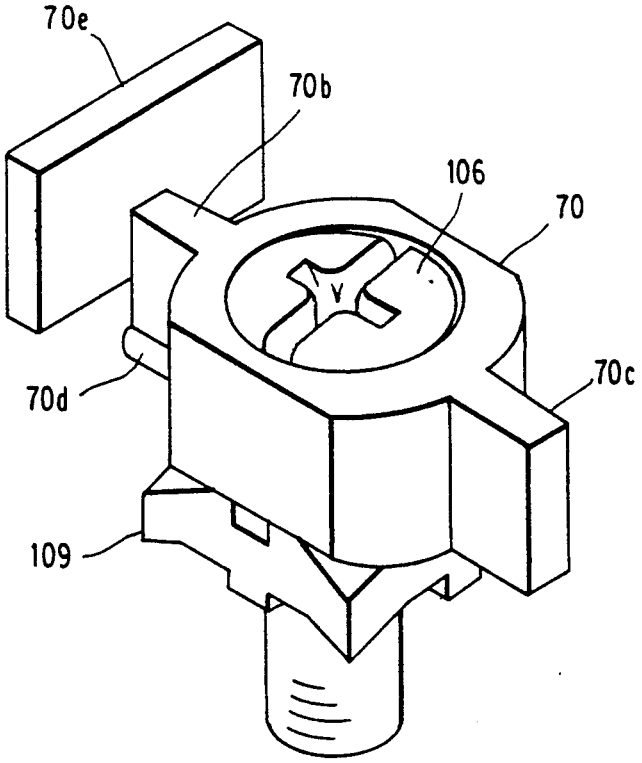
FIG. 31 is a perspective view of a holder retaining a terminal screw for use with the twentieth preferred embodiment of the present invention.

The joined state of the holder 70 and the terminal screw 106 is shown in FIG. 31. Reference numeral 102e indicates a nearly U-shaped holder fitting portion molded integrally with a cover 102 and made of a material, e.g., thermoplastic resin, having elastic and insulation properties. The holder fitting portion has guide grooves 102f, 102g in two opposing surfaces where projections 70b, 70c, provided on the outer periphery of the holder 70, fit slidably. An engagement projection 70d provided under the projection 70b is fastened in a recess 102h or 102i formed in the guide groove 102f of the holder fitting portion 102e.

The lower recess 102i (on the right-hand side in FIG. 30) is longer than the upper recess 102h for fastening in the first position (on the left-hand side in FIG. 30) so that the engagement projection 70d of the holder 70 may fit recess 102i while the terminal screw 106 is threaded into the internally threaded hole 108a of the stationary terminal 108 and may move upward (left in FIG. 30) when the front end of the terminal screw 106 abuts on the internally threaded hole 108a of the stationary terminal 108. There is also provided a holder operating portion 70e, which is in parallel with a surface having the guide groove 102f of the holder fitting portion 102e, at right angles with the projection 70b provided on the outer periphery of the holder 70.

The top surface of the holder fitting portion 102e includes an insertion hole 102j for inserting a screwdriver or other tool (not shown) which is employed to thread the terminal screw 106. Further, 102k (See FIG. 33) indicates a connected portion of the cover 102 and the holder fitting portion 102e, which is elastic and can be bent such that the holder fitting portion 102e is pivotable about the connected portion 102k.

In FIG. 30, 102l indicates an engagement boss provided on the holder fitting portion 102e which fits into and is engaged with a recess 101e in the case 101 and generally fastens the holder fitting portion 102e to the case 101.

The procedures of wiring the terminal connecting device of the present embodiment will be described hereinafter. It is assumed that there are three types of cable terminals to be connected to the terminal connecting device, a round solderless terminal, a naked wire or the like and a beveled, solderless terminal. First, the wiring of the round solderless terminal will be described. In FIG. 28, which shows the terminal screws 106 and the holder 70 in a first position, a gap "G" is provided between the front end of the terminal screw 106 and the stationary terminal 108.

Since this gap is set to be at least larger than the plate thickness "T" of the round solderless terminal, the round solderless terminal can pass through said gap into alignment with the terminal screw 106, the terminal screw 106 thereafter being threadably engaged with the female threaded hole of the stationary terminal 108.

In particular, by pressing the head 106a of the terminal screw 106 with a screwdriver or the like, the engagement projection 70d of the holder 70 escapes from the recess 102h of the holder fitting portion 102e and is moved downward along with the holder 70, the front end of the terminal screw 106 thereby being inserted into the hole 108a of the round solderless terminal and further threaded therein. This completes the wiring procedure.

The wiring procedure of the wire or the beveled solderless terminal to the terminal connecting device of the present embodiment will be described hereinafter. In this case, in order to prevent the wire from entering and biting the internally threaded hole 108a of the stationary terminal 108, the holder 70 is lowered to a position where the front end of the terminal screw 106 abuts on the stationary terminal 108. Namely, as shown in FIG. 28, by pushing the terminal screw 106 downward, the holder 70 joined thereto also moves downward. At this time, the engagement projection 70d of the holder 70 escapes from the recess 102h, moves downward within the guide groove 102f, and is fastened in a position where it fits in the upper side (left-hand side) of the recess 102i, i.e., in wherein the front end of the terminal screw 106 is abutting on or has slightly entered the internally threaded hole 108a.

By inserting the wire or the beveled solderless terminal under the cable presser 109 and tightening the terminal screw 106 in this state, i.e., in the second position, the wiring procedure is completed.

The above described tightening causes the engagement projection 70d of the holder 70 to escape from the recess 102i and move downward. Since the recess 102i is formed so that the terminal screw 106 may escape by the thrust force of the terminal screw rotation after the same is only slightly threaded into the internally threaded portion 108a, as shown in FIG. 30, the terminal screw 106 need not be pushed down and can be tightened smoothly without significant resistance.

Figure 32:
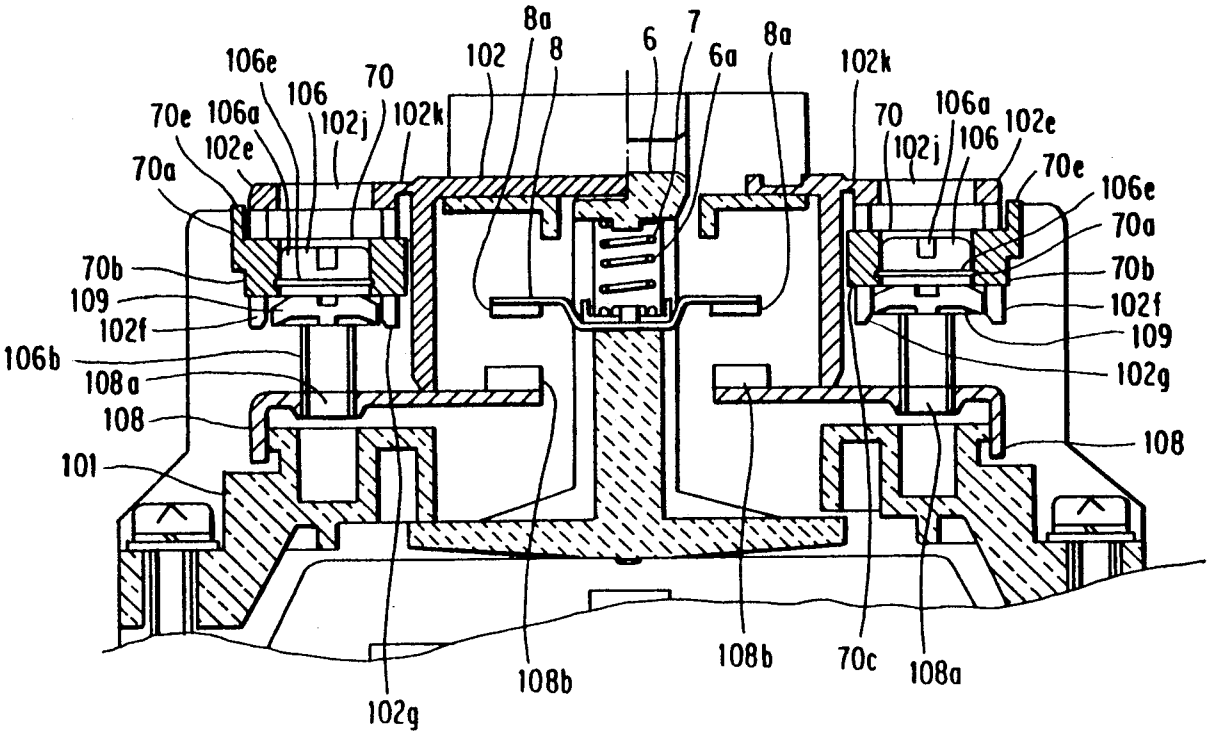
FIG. 32 illustrates a state wherein the holder is in a second position in which a terminal screw front end abuts on an internally threaded hole drilled in the terminal shown in FIG. 28.

To return from the position, as shown in FIG. 32 and at the top of FIG. 30, to the upper position, as shown in FIG. 28 and in the middle of FIG. 30, the holder operating portion 70e is moved upward, or left in FIG. 30. This causes the guide groove 102f of the holder fitting portion 102e to widen in the direction of the arrow "C" shown in FIG. 30, and the engagement projection 70d of the holder 70 to escape from the recess 102i and move upward, left in FIG. 30, whereby the holder 70 is returned to the state shown in FIG. 28 and in the middle of FIG. 30, i.e., the first position.

When the terminal screw 106 is loosened from a completely tightened position (not shown), the engagement projection 70d of the holder 70 is positioned into the recess 102i of the holder fitting portion 102e by the thrust force of the terminal screw 106 slightly before it is released from the internally threaded hole 108a. Hence, the terminal screw 106 is loosened smoothly and efficiently.

As described above, the terminal connecting device of the present embodiment includes the engagement projection 70d of the holder 70 and the recesses 102h, 102i of the holder fitting portion 102, etc., so that holder 70 may be fastened in two positions, the first position where the front end of the terminal screw 106 is located a predetermined distance away from the surface of the stationary terminal 108, and the second position where the front end of the terminal screw 106 abuts on the internally threaded hole 108a bored in the stationary terminal 108. Since the holder 70 can be readily and reliably fastened in these two positions, the holder 70 and the terminal screw 106 can be preset to either of said two positions depending on the termination type of the cable, and further workability is much improved.

In displacing the holder operating portion 70e upwardly, the holder operating portion 70e, which is in parallel with the surface having the guide groove 102f of the holder fitting portion 102e, allows the inclination of the holder 70 (in the direction of the arrow "D" shown in FIG. 28) to be reduced if the uplifting force is applied at a point distant from the center of the terminal screw 106, the holder 70 and the terminal screw 106 being lifted smoothly.

As described above, the holder operating portion 70e is designed to be in parallel with the surface including the guide groove 102f of the holder fitting portion 102e and at right angles with the projection 70b of the holder 70. When the holder 70 is moved in the vertical direction, therefore, its inclination is reduced and the holder 70 can be lifted smoothly.

The wiring procedure of the round solderless terminal 22 to the terminal connecting device of the present embodiment will now be described with reference to FIGS. 30 and 33. Pushing up the holder operating portion 70e, left in FIG. 30, disengages the engagement boss 102l of the holder fitting portion 102e from the recess 101e of the case 101, whereby the holder fitting portion 102e can be bent as shown in FIG. 33 at the joint portion 102k of the cover 102 and the holder fitting portion 102e.

After inserting the terminal screw 106 into the hole of the round solderless terminal 22, the entire assembly is returned to the original position. This engages the engagement boss 102l of the holder fitting portion 102e with the recess 101e of the case 101 as shown in FIG. 28. Thereafter, the wiring is completed by performing the threading work as described above.

Figure 33:
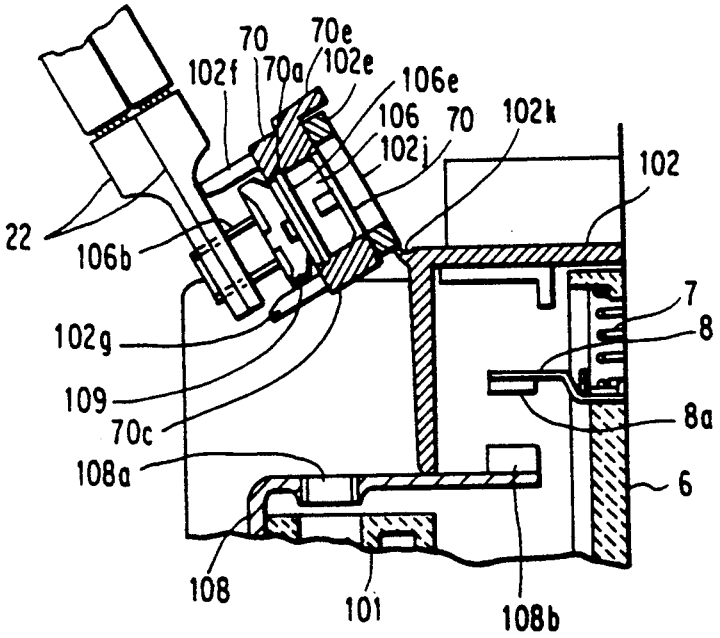
FIG. 33 illustrates a state, wherein a holder fitting portion, as shown in the twentieth preferred embodiment, is pivoted.

With the holder fitting portion 102e pivoted as shown in FIG. 33, the holder 70 can be fastened by the engagement projection 70d of the holder 70 and the recess 102h or 102i of the holder fitting portion 102e, thereby keeping the holder 70 from falling off the holder fitting portion 102e. Also, since the projections 70b, 70c of the holder 70 fit into and are engaged with the guide grooves 102f, 102g of the holder fitting portion 102e, respectively, the holder 70 does not rotate, is not offset from the holder fitting portion 102e, and is easily returned to the original position of the case 101.

As described above, the present invention is designed to allow the holder fitting portion 102e retaining the holder 70 which retains the terminal screw 106 to be bent and pivoted on the joint portion. Therefore, if the installation position of the equipment is high or low, or the wiring is difficult, e.g., double wiring of the round solderless terminal, the front end of the terminal screw 106 can be inserted beforehand into the hole of the round solderless terminal 22, enhancing workability.

Also, since the holder can be fastened by the engagement projection 70d of the holder 70 and the recesses 102h, 102i, etc., of the holder fitting portion 102e, the holder 70 does not fall off. Further, the engagement of the projections 70b, 70c of the holder 70 with the guide grooves 102f, 102g of the holder fitting portion 102e prevents the holder 70 from rotating and allows the holder fitting portion 102e to be returned to the original position smoothly, ensuring improved workability.

The terminal connecting device, as described above, may be used not only with magnetic contactors but also with any other electrical equipment having a terminal section such as circuit breakers, overload relays and transformers.

The present invention, as described above, relates to a terminal connecting device which aligns the threaded portion of a terminal screw with a threaded hole when the terminal screw is moved toward the threaded hole, ensures ease of tightening the terminal screws, and remarkably improves workability.

The present invention further relates to a terminal connecting device which retains the terminal screw in a position where the threaded portion of the terminal screw abuts on or is adjacent to the threaded hole. In this state, a beveled, solderless terminal or naked wire can be connected to a stationary terminal without having part of the terminal wire enter the threaded hole. Furthermore, the terminal screw is retained in a position where a gap is produced between the threaded portion of the terminal screw and the threaded hole. By inserting a round solderless terminal into this gap, the round solderless terminal can be connected to the stationary terminal. Thus, almost any type of terminal is easily and reliably accommodated by the present invention.

The present invention further relates to a terminal connecting device that allows either of two positions, a first position where a gap is generated between the threaded portion of the terminal screw and the threaded hole, and a second position where the threaded portion of the terminal screw abuts on or is adjacent to the threaded hole, either of the two positions being easily and efficiently selected. Furthermore, the terminal connecting device permits the round solderless terminal to be wired by selecting the first position and to be temporarily secured by selecting the second position after the round solderless terminal has been inserted, thereby significantly improving the wiring workability for a wide variety of terminal types.

The present invention further relates to a terminal connecting device which does not require removal of a terminal screw holder when switching between the two positions, i.e., the first and second positions, thereby preventing hazards such as electrical shock.

The present invention further relates to a terminal connecting device wherein a holder portion is slidably engaged in such a manner as to prevent problems with respect to wiring and to prevent the removal of the holder during the same.

The present invention further relates to a terminal connecting device that is provided with a third position, as the stable position of the terminal screw holder in the sliding direction, where the front end of the terminal screw has been tightened several turns into the internally threaded hole of the stationary terminal, in addition to the first and second positions, the third position allowing the terminal screw to be retained in and released from the terminal screw holder by the thrust force of the terminal screw, the terminal screw being retained and released automatically with reliable reproducibility by simply tightening and loosening the terminal screw, the terminal screw being removed from the terminal screw holder in the fully tightened position so as to prevent, for example, deformation caused by heat generation within the terminal screw, etc.

The present invention relates to a terminal connecting device that is designed such that a holder fitting portion is bent and pivoted about a joint portion with the body if, for example, the mounting position of the equipment is unusually low or high, or wiring is difficult Also, the terminal screw can be inserted beforehand into the hole of the round solderless terminal, improving workability.

The present invention further relates to a terminal connecting device in which the holder serves as a guide for a screwdriver or the like for tightening the terminal screw. In addition, since the holder is formed of an insulative material, it may also acts as a safety cover which prevents electrical shock when the terminal screw is contacted.

What is claimed is:

1. A terminal connecting device comprising:

stationary terminals having female-threaded holes;

a side wall having terminal screw holder guides;

terminal screws having male-threaded portions screwed into said female-threaded holes;

terminal screw guiding members retaining said terminal screws and guided by said terminal screw holder guides so that the male-threaded portions of said terminal screws are substantially aligned with said female-threaded holes; and elastic members for biasing said terminal screws and said terminal screw guiding members so as to form a predetermined gap between a lower end of the male-threaded portions of the terminal screws and the stationary terminals when the terminal screws are in a first position;

wherein said terminal screw holder guides of said side wall are provided with engaging portions and the terminal screw guiding members are provided with engaged portions, each of said engaging portions and said engaged portions being inter-engaged to retain the terminal screws in a second position where the lower ends of the male-threaded portions of the terminal screws are adjacent to, abut on, or slightly enter the female-threaded holes of the stationary terminals against the elastic force of the elastic members.

2. A terminal connecting device as defined in claim 1, wherein each elastic member is substantially arc-shaped to allow a tool for threading the terminal screws to be inserted therethrough, with one end of the elastic members being supported by the side wall and the other ends thereof secured to or engaged with said terminal screws or terminal screw guiding members, said elastic members pulling said terminal screws and terminal screw guiding members in a direction such that a gap is formed between the lower ends of the male-threaded portions of the terminal screws and the stationary terminals.

3. A terminal connecting device comprising:

stationary terminals having female-threaded holes;

a side wall having terminal screw holder guides;

terminal screws having male-threaded portions screwed into said female-threaded holes;

terminal screw guiding members retaining said terminal screws and guided by said terminal screw holder guides so that the male-threaded portions of said terminal screws are substantially aligned with said female-threaded holes; and elastic members for retaining said terminal screws and said terminal screw guiding members with elastic force so as to form a predetermined gap between the lower end of the male-threaded portions of the terminal screw and the stationary terminals when said terminal screws are not screwed into the female-threaded holes of the stationary terminals;

said elastic members comprising a pair of substantially arc-shaped elastic pieces disposed opposite to each other with a predetermined distance therebetween so as to form a substantially cylindrical space therebetween with one end of said elastic members being supported by the side wall and the other end being secured to or engaged with said terminal screws or terminal screw guiding members, said elastic members pulling said terminal screws and terminal screw guiding members in a direction in which a gap is formed between the lower ends of the male-threaded portions of the terminal screws and the stationary terminals.

4. A terminal connecting device as defined in claim 3, wherein the side wall is provided with engaging portions and the terminal screw guiding members are provided with engaged portions, each of said engaging portions and said engaged portions being inter-engaged to retain the terminal screws in a position where the lower ends of the male-threaded portions of the terminal screws are adjacent to, abut on, or slightly enter the female-threaded holes of the stationary terminals against the elastic force of the elastic members.

5. A terminal connecting device as defined in claim 1 wherein each terminal screw guiding member and each elastic member are integrally molded from an electrically insulative synthetic resin.

6. A terminal connecting device as defined in any one of claims 1, 2 or 4, wherein the terminal screw holder guides of the side wall are grooves, and the engaged portion of each terminal screw guiding member is made of elastic material, substantially U-shaped, and fitted slidably into said grooves, so that when the terminal screw guiding members are slid against the elastic force of the elastic members until the lower end of the male-threaded portions of the terminal screws are adjacent to, abut on, or slightly enter the female-threaded hole of the stationary terminal, both sides of the substantially U-shaped engaged portion are spread and fastened to the engaging portion of the terminal screw holder guides.

7. A terminal connecting device for connecting an electric line comprising:

a stationary terminal having a female-threaded hole;

a supporting member including a stationary portion and a side wall, said stationary portion serving to immovably hold said stationary terminal;

a terminal screw having a male-threaded portion to be screwed with said female-threaded hole of said stationary terminal for holding said electric line;

a terminal screw guiding member, which is interengaged with said terminal screw, for guiding displacement of said terminal screw along said side wall such that said male-threaded portion of said terminal screw is substantially aligned with said female-threaded hole position of said stationary terminal; and at least one elastic member of which one end is supported by said side wall and of which the other end holds said terminal screw and said guiding member so as to form a space between said male-threaded portion of said terminal screw and said hole of said stationary terminal in a non-connecting state therebetween.

8. A terminal connecting device according to claim 7, wherein said other end of said elastic member is fixed to said terminal screw guiding member.

9. A terminal connecting device according to claim 8, in which said side wall is provided with an engaging portion and said terminal screw guiding member is provided with an engaged portion which is hooked by said engaging portion of said side wall so as to maintain a contact or an adjacent position of said terminal screw to said hole of said stationary terminal.

10. A terminal connecting device according to claim 8, wherein said elastic member comprises two zigzag shaped springs.

11. A terminal connecting device according to claim 10, wherein said elastic member and said terminal screw guiding member are integrally formed.

12. A terminal connecting device according to claim 8, wherein said elastic member is a coil spring.

13. A terminal connecting device according to claim 12, wherein said elastic member and said terminal screw guiding member are integrally formed.

14. A terminal connecting device according to claim 8, wherein said terminal screw guiding member is provided with an engaging member for engaging said terminal screw with said terminal screw guiding member, in which an outer peripheral portion of said engaging member is held to an annular portion of said terminal screw guiding member and is undetachably interposed between the head portion of said terminal screw and said male-threaded portion.

15. A terminal connecting device according to claim 14, wherein said engaging member is movably held to said annular portion of said terminal screw guiding member.

16. A terminal connecting device according to claim 15, further comprising a wire retainer, for retaining said electric wire in connection, said wire retainer being undetachably interposed between said engaging member and said male-threaded portion.

17. A terminal connecting device according to claim 14, wherein said engaging member retains said electric wire in connection.

18. A terminal connecting device according to claim 17, wherein said engaging member is movably secured to said annular portion of said terminal screw guiding member.

19. A terminal connecting device according to claim 8, wherein said terminal screw guiding member is held to said terminal screw by movably engaging a peripheral portion of said terminal screw with an annular portion provided on said terminal screw guiding member.

20. A terminal connecting device according to claim 7, wherein said other end of said elastic member holds said terminal screw to movably engage a peripheral portion of said terminal screw with an annular portion provided on said elastic member.

21. A terminal connecting device according to claim 20, in which said side wall is provided with an engaging portion and said terminal screw guiding member is provided with an engaged portion which is hooked by said engaging portion of said side wall so as to maintain a predetermined gap between said terminal screw and said hole of said stationary terminal.

22. A terminal connecting device according to claim 20, wherein said elastic member is a coil spring.

23. A terminal connecting device according to claim 22, wherein said elastic member and said terminal screw guiding member are integrally formed.

24. A terminal connecting device according to claim 20, wherein said terminal screw guiding member is provided with an engaging member for engaging said terminal screw with said terminal screw guiding member, an outer peripheral portion of said engaging member being held to an annular portion of said terminal screw guiding member and undetachably interposed between a head portion of said terminal screw and said male-threaded portion.

25. A terminal connecting device according to claim 24, wherein said engaging member is movably attached to said annular portion of said terminal screw guiding member.

26. A terminal connecting device according to claim 25, further comprising a wire retainer for retaining said electric wire in connection, said wire retainer being undetachably interposed between said head portion of said terminal screw and said male-threaded portion.

27. A terminal connecting device according to claim 24, wherein said engaging member retains said electric wire in connection.

28. A terminal connecting device according to claim 27, wherein said engaging member is movably held to said annular portion of said terminal screw guiding member.

* * * * *